US009805650B2

(12) United States Patent
Gu

(10) Patent No.: US 9,805,650 B2
(45) **Date of Patent: *Oct. 31, 2017**

(54) ORGANIC LIGHT EMITTING DIODE PIXEL DRIVING CIRCUIT AND DISPLAY DEVICE

(71) Applicants: Shanghai Tianma AM-OLED Co., Ltd., Shanghai (CN); Tianma Micro-Electronics Co., Ltd., Shenzhen (CN)

(72) Inventor: Hanyu Gu, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 14 days.

This patent is subject to a terminal disclaimer.

(21) Appl. No.: 14/470,703

(22) Filed: Aug. 27, 2014

(65) Prior Publication Data

US 2015/0364087 A1 Dec. 17, 2015

(30) Foreign Application Priority Data

Jun. 13, 2014 (CN) ..... 2014 1 0264616

(51) Int. Cl.
*G09G 3/32* (2016.01)
*G09G 3/3233* (2016.01)

(52) U.S. Cl.
CPC ... *G09G 3/3233* (2013.01); *G09G 2300/0842* (2013.01); *G09G 2300/0861* (2013.01);
(Continued)

(58) Field of Classification Search
CPC ..... G09G 3/30; G09G 3/32; G09G 3/3208; G09G 3/3225; G09G 3/3233
See application file for complete search history.

(56) References Cited

U.S. PATENT DOCUMENTS

2011/0221940 A1* 9/2011 Kato ..... H04N 5/3745 348/250
2012/0062536 A1* 3/2012 Park ..... G09G 3/3233 345/211

(Continued)

FOREIGN PATENT DOCUMENTS

CN 1744774 A 3/2006
CN 1870111 A 11/2006

(Continued)

OTHER PUBLICATIONS

Office Action as issued in corresponding German Application 102014114957.2 dated May 18, 2015 and English translation thereof.

(Continued)

*Primary Examiner* — Carolyn R Edwards
*Assistant Examiner* — Bipin Gyawali
(74) *Attorney, Agent, or Firm* — Alston & Bird LLP

(57) ABSTRACT

An organic light emitting diode pixel driving circuit includes an external circuit and multiple intra-pixel circuits. Each of the intra-pixel circuits includes a signal loading module, a driving transistor and an organic light emitting diode. Each of the signal loading modules is configured to store an image data signal and the threshold voltage of the driving transistor as a drive signal and load the drive signal to the gate of the driving transistor in a signal loading phase, and to control the driving transistor by the drive signal stored in the signal loading phase and a signal at a source of the driving transistor to drive the organic light emitting diode to emit light in a light emitting phase. The external circuit is configured to load a first power supply signal to the source of the driving transistor in the light emitting phase.

14 Claims, 15 Drawing Sheets

(52) U.S. Cl.
CPC ..... *G09G 2300/0866* (2013.01); *G09G 2310/0262* (2013.01); *G09G 2310/08* (2013.01); *G09G 2320/045* (2013.01)

(56) References Cited

U.S. PATENT DOCUMENTS

| | | | | |
|---|---|---|---|---|
| 2012/0139892 | A1* | 6/2012 | Oh | G09G 3/3648 345/212 |
| 2013/0050292 | A1 | 2/2013 | Mizukoshi | |
| 2013/0314574 | A1* | 11/2013 | Ishii | H01L 27/1461 348/302 |
| 2014/0152705 | A1* | 6/2014 | Kwon | G09G 3/3275 345/690 |
| 2016/0155385 | A1* | 6/2016 | Yang | G09G 3/3233 345/174 |

FOREIGN PATENT DOCUMENTS

| | | | |
|---|---|---|---|
| CN | 102194407 | A | 9/2011 |
| CN | 102364568 | A | 2/2012 |
| DE | 102010061736 | A1 | 6/2011 |
| DE | 102011078864 | A1 | 3/2012 |
| DE | 102011055858 | A1 | 9/2012 |
| KR | 1020050038906 | A | 4/2005 |
| KR | 10-0903496 | B1 | 6/2009 |
| KR | 10-20120009671 | A | 2/2012 |

OTHER PUBLICATIONS

Office Action as issued in corresponding Chinese Application No. 201410264616.X, dated Oct. 12, 2015.

* cited by examiner

ORGANIC LIGHT EMITTING DIODE PIXEL DRIVING CIRCUIT AND DISPLAY DEVICE

CROSS-REFERENCES TO RELATED APPLICATIONS

This application claims the benefit of priority to Chinese Patent Application No. 201410264616.X, filed with the Chinese Patent Office on Jun. 13, 2014 and entitled "ORGANIC LIGHT EMITTING DIODE PIXEL DRIVING CIRCUIT AND DISPLAY DEVICE", the content of which is incorporated herein by reference in its entirety.

BACKGROUND OF THE INVENTION

Field

The present invention relates to the field of display technologies, and particularly to an organic light emitting diode pixel driving circuit and a display device.

Background

An Active Matrix Organic Light Emitting Diode (AMOLED) display has been widely applied due to its wide angle of view, good color contrast effect, high response speed, low cost and other advantages. However, threshold voltage drift may arise as a result of non-uniformity and instability of a Thin Film Transistor (TFT) back panel in a process flow.

FIG. 1 illustrates an existing pixel circuit including a transistor T1, a transistor T2, a transistor T3, a transistor T4, a transistor T5, a storage capacitor C1 and an Organic Light Emitting Diode (OLED), and FIG. 2 illustrates a timing diagram of the circuit in operation.

When a scan signal Scan (n−1) of the (n−1)-th row is at a low level and a scan signal Scan (n) of the n-th row is at a high level, the transistor T1 and the transistor T4 are turned off, and the transistor T5 is turned on, so the transistor T2 and the transistor T3, arranged in a mirror structure, are also turned off, so that a signal stored on the storage capacitor C1 is initialized by the transistor T5 using an initial voltage signal Vinit. When the scan signal Scan (n−1) of the (n−1)-th row is at a high level and a scan signal Scan (n) of the n-th row is at a low level, the transistor T1 and the transistor T4 are turned on, and the transistor T5 is turned off, so the transistor T2 and the transistor T3, arranged in the mirror structure, are also turned on, so that an image data signal Data is transmitted to a gate of the transistor T2 through the transistor T1 and the transistor T3, and at this time the transistor T4 is turned on, so a drive current dependent upon the signal loaded to the gate of the transistor T2 flows through the OLED to drive it to emit light. The voltage of the signal loaded to the transistor T2 is Vdata+Vth3, where Vdata is the voltage of the image data signal Data, and Vth3 is the threshold voltage of the transistor T3, and the drive current flowing through the OLED is $Ioled=(k/2)(Vdata-Vdd+Vth3-Vth2)^2$, where k is a constant, Vdd is the voltage of a high-level signal Vdd, and Vth2 is the threshold voltage of the transistor T2.

Although the transistor T2 and the transistor T3, constituting a current mirror, are arranged adjacent to each other on a substrate, it may be difficult to make their threshold voltage substantially the same due to a TFT parameter in a fabrication process, and it may be difficult to make the drive current the same when the same image data signal is received due to the threshold voltage drift of either of the transistors, which may degrade a display quality.

In summary, in the existing organic light emitting diode pixel circuit, it may be difficult to make the threshold voltage of two TFTs consisting a current mirror substantially the same, so it may be difficult to make the drive current the same when the same image data signal is received due to the threshold voltage drift of either of the transistors, which may degrade display quality.

BRIEF SUMMARY OF THE INVENTION

An embodiment of the invention provides an organic light emitting diode pixel driving circuit including an external circuit and a number m of intra-pixel circuits, each of intra-pixel circuits includes a signal loading module, a driving transistor and an organic light emitting diode, wherein m is an integer greater than or equal to 2 and smaller than or equal to a total number of pixel elements on a display panel;

a first terminal of the external circuit receives a first power supply signal, and a second terminal of the external circuit is connected respectively with sources of the driving transistors of the m intra-pixel circuits;

for each of the signal loading modules, a first terminal of the signal loading module receives the first power supply signal, a second terminal of the signal loading module is connected with the source of the driving transistor of the intra-pixel circuit including the signal loading module, a third terminal of the signal loading module is connected with a gate of the driving transistor, a fourth terminal of the signal loading module is connected with a drain of the driving transistor, a fifth terminal of the signal loading module is connected with an anode of the organic light emitting diode of the intra-pixel circuit including the signal loading module, a cathode of the organic light emitting diode receives a second power supply signal, and a sixth terminal of the signal loading module receives an image data signal;

each of the signal loading modules is configured, in a signal loading phase, to load the image data signal, received by its sixth terminal, to the source of the driving transistor of the intra-pixel circuit including the signal loading module by its second terminal, to have its third terminal connected with its fourth terminal to generate and store a drive signal, and to have its fourth terminal disconnected from its fifth terminal; and in a light emitting phase, to have its third terminal disconnected from its fourth terminal, to have its fourth terminal connected with its fifth terminal, and to control the driving transistor by the drive signal stored in the signal loading phase and the signal at the source of the driving transistor to drive the organic light emitting diode in the intra-pixel circuit including the signal loading module to emit light; and the external circuit is configured to have its first terminal disconnected from its second terminal in the signal loading phase, and to have its first terminal connected with its second terminal in the light emitting phase.

An embodiment of the invention provides an organic light emitting diode pixel driving circuit including an external circuit and a number m of intra-pixel circuits, each of intra-pixel circuits includes a signal loading module, a driving transistor and an organic light emitting diode, wherein the m intra-pixel circuits are connected with the same data line, and m is an integer greater than or equal to 2 and smaller than or equal to a total number of pixel elements connected with the same data line;

a first terminal of the external circuit receives a first power supply signal, a second terminal of the external circuit is connected respectively with sources of the driving transistors of the m intra-pixel circuits, a third terminal of the external circuit receives an image data signal, and a fourth terminal of the external circuit is connected respectively with the sources of the m driving transistors;

for each of the signal loading modules, a first terminal of the signal loading module receives the first power supply signal, a third terminal of the signal loading module is connected with a gate of the driving transistor, a fourth terminal of the signal loading module is connected with a drain of the driving transistor, a fifth terminal of the signal loading module is connected with an anode of the organic light emitting diode of the intra-pixel circuit including the signal loading module, and a cathode of the organic light emitting diode receives a second power supply signal;

the external circuit is configured, in a signal loading phase, to have its first terminal disconnected from its second terminal, to have its third terminal connected with its fourth terminal, and to transmit the image data signal to the source of the driving transistor by its fourth terminal; and in a light emitting phase, to have its first terminal connected with its second terminal; and each of the signal loading modules is configured, in the signal loading phase, to have its third terminal connected with its fourth terminal to generate and store a drive signal, and to have its fourth terminal disconnected from its fifth terminal; and in the light emitting phase, to have its third terminal disconnected from its fourth terminal, to have its fourth terminal connected with its fifth terminal, and to control the driving transistor by the drive signal stored in the signal loading phase and the signal at the source of the driving transistor to drive the organic light emitting diode of the intra-pixel circuit comprising the signal loading module to emit light.

An embodiment of the invention provides an organic light emitting diode pixel driving circuit including an external circuit and a number m of intra-pixel circuits, wherein m is an integer greater than or equal to 2 and smaller than or equal to a total number of pixel elements on a display panel;

the external circuit includes a first switch transistor;

the first switch transistor includes a first terminal which receives a first power supply signal, and a gate which receives a first light emitting control signal;

each of the intra-pixel circuits includes a second switch transistor, a third switch transistor, a fourth switch transistor, a driving transistor, a first capacitor and an organic light emitting diode;

the second switch transistor includes a first terminal which receives an image data signal, and a gate which receives a first scan signal;

the first capacitor includes one terminal plate which receives the first power supply signal, and the other terminal plate which is connected respectively with a gate of the driving transistor and a first terminal of the fourth switch transistor;

the driving transistor includes a source which is connected respectively with a second terminal of the first switch transistor and a second terminal of the second switch transistor, and a drain which is connected respectively with a first terminal of the third switch transistor and a second terminal of the fourth switch transistor;

the third switch transistor includes a gate which receives a second light emitting control signal, and a second terminal which is connected with an anode of the organic light emitting diode;

the fourth switch transistor includes a gate which receives a second scan signal; and the organic light emitting diode includes a cathode which receives a second power supply signal.

An embodiment of the invention provides an organic light emitting diode pixel driving circuit including an external circuit, and a number m of intra-pixel circuits connected with the same data line, wherein m is an integer greater than or equal to 2 and smaller than or equal to a total number of pixel elements connected with the same data line;

the external circuit includes a first switch transistor and a second switch transistor;

the first switch transistor includes a first terminal which receives a first power supply signal, and a gate which receives a first light emitting control signal;

the second switch transistor includes a first terminal which receives an image data signal, and a gate which receives a first scan signal;

each of the intra-pixel circuits includes a third switch transistor, a fourth switch transistor, a driving transistor, a first capacitor and an organic light emitting diode;

the first capacitor includes one terminal plate which receives the first power supply signal, and the other terminal plate which is connected respectively with a gate of the driving transistor and a first terminal of the fourth switch transistor, the driving transistor includes a source which is connected respectively with a second terminal of the first switch transistor and a second terminal of the second switch transistor, and a drain which is connected respectively with a first terminal of the third switch transistor and a second terminal of the fourth switch transistor;

the third switch transistor includes a gate which receives a second light emitting control signal, and a second terminal which is connected with an anode of the organic light emitting diode;

the fourth switch transistor includes a gate which receives a second scan signal; and the organic light emitting diode includes a cathode which receives a second power supply signal.

An embodiment of the invention provides a display device including the organic light emitting diode pixel driving circuit according to any one of the embodiments of the invention.

Advantages of the embodiments of the invention may include:

With the organic light emitting diode pixel driving circuit and the display device according to the embodiments of the invention, the signal loading module of each of the intra-pixel circuits can have the third terminal of the signal loading module connected with the fourth terminal of the signal loading module, that is, have the gate of the driving transistor connected with the drain thereof, when the image data signal is loaded to the source of the driving transistor, so the signal at the gate of the driving transistor is the sum of the voltage of the image data signal and the threshold voltage of the driving transistor when the image data signal is loaded to the source of the driving transistor, so that as is apparent from the equation of a transistor operating in saturation, the drain current of the driving transistor is independent from the threshold voltage thereof when the organic light emitting diode is driven by the driving transistor using the signal at the gate thereof to emit light, and thus in the organic light emitting diode pixel driving circuit and the display device according to the embodiments of the invention, the organic light emitting diode can be driven by the same current when the same image data signal is received to thereby improve the display quality. The organic light emitting diode pixel driving circuit according to the embodiments of the invention includes two components, one of which is the external circuit, and the other of which is the intra-pixel circuits, where the external circuit can be shared by the m pixel elements, and each of the intra-pixel circuits is located in corresponding one of the pixel elements; and in order to drive one of the pixel elements, the intra-pixel circuit in the pixel element shall operate together with the external circuit shared by the pixel element to drive the pixel element to emit light. The number of devices in the pixel elements can be lowered and the size of the pixel elements can be shrunk in the organic light emitting diode pixel driving circuit according to the embodiments of the invention to thereby make it particularly suitable for a display panel with high-resolution. Furthermore, the total number of devices in the pixel driving circuits on the display panel can be reduced and the size of the display panel can be reduced to further minimize the display device.

DETAILED DESCRIPTION OF THE INVENTION

With an organic light emitting diode pixel driving circuit and a display device according to embodiments of the invention, a signal loading module in each of intra-pixel circuits can connect a gate of a driving transistor with a drain thereof, when an image data signal is loaded to a source of the driving transistor, so a signal at the gate of the driving transistor is the sum of the voltage of the image data signal and the threshold voltage of the driving transistor when the image data signal is loaded to the source of the driving transistor, so that as is apparent from the equation of a transistor operating in saturation, the drain current of the driving transistor is independent from the threshold voltage thereof when an organic light emitting diode is driven by the driving transistor using the signal at the gate thereof to emit light, and thus in the organic light emitting diode pixel driving circuit and the display device according to the embodiments of the invention, the organic light emitting diode can be driven by the same current when the same image data signal is received, thereby improving the quality of the display.

Specific implementations of the organic light emitting diode pixel driving circuit and the display device according to the embodiments of the invention will be described below with reference to the drawings.

Figure 1:
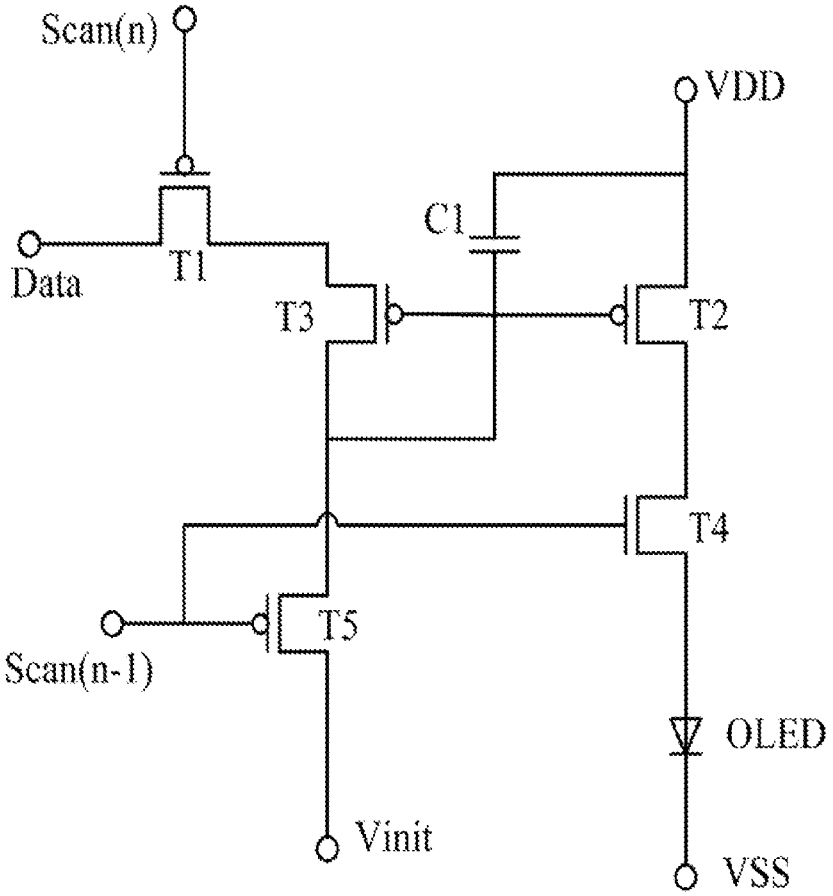
FIG. 1 (Prior Art)
FIG. 1 is a schematic structural diagram of a pixel circuit in the prior art.
Figure 2:
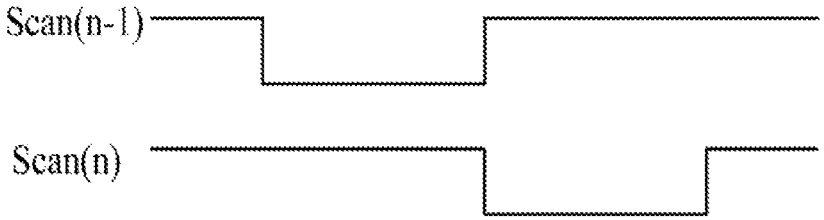
FIG. 2 (Prior Art)
FIG. 2 is a timing diagram of the circuit illustrated in FIG. 1 in operation.
Figure 3:
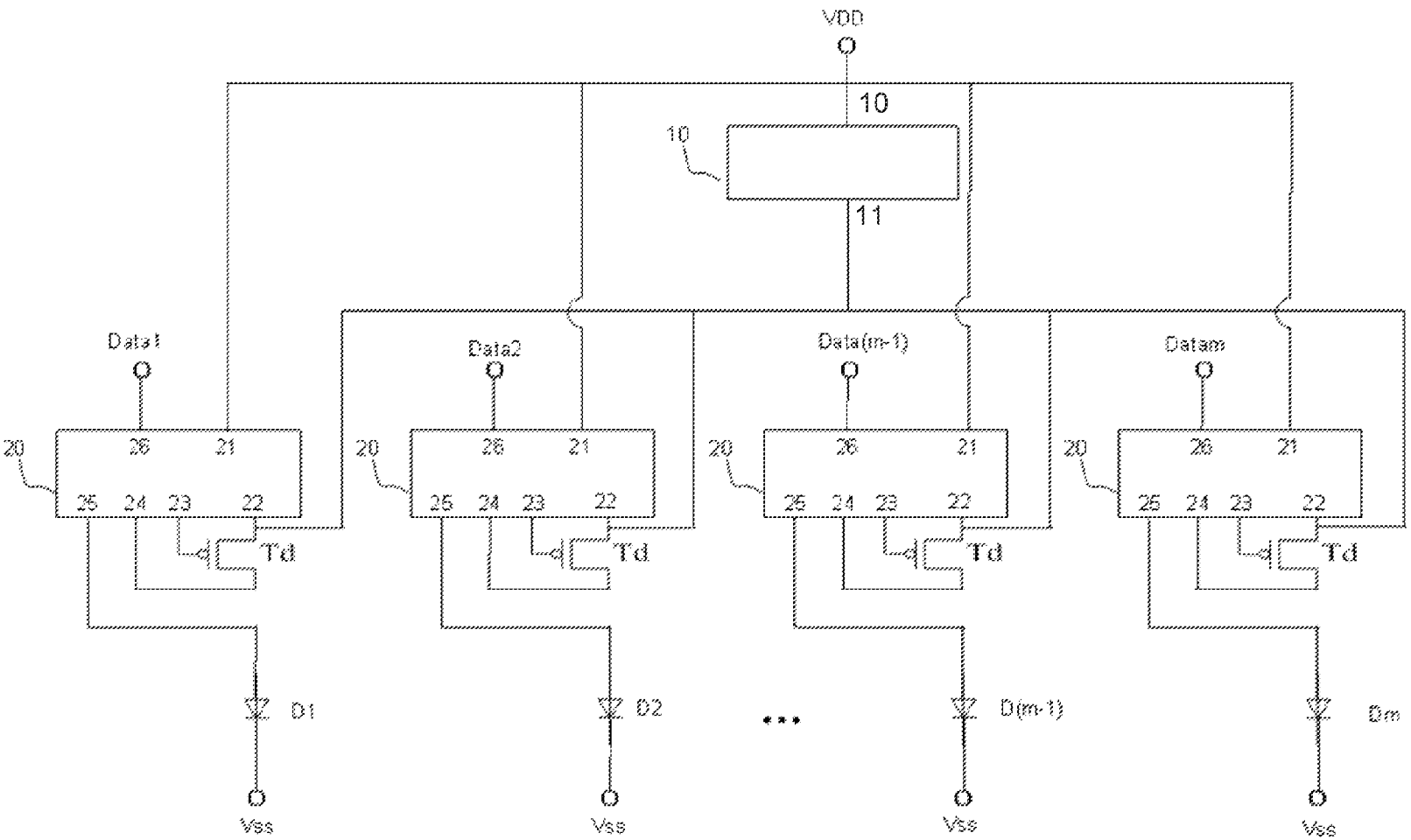
FIG. 3 is a simplified block diagram of an organic light emitting diode pixel driving circuit according to a first embodiment of the invention

FIG. 3 illustrates an organic light emitting diode pixel driving circuit according to a first embodiment of the invention, which includes an external circuit 10 and a number m of intra-pixel circuits, where m is an integer greater than or equal to 2 and smaller than or equal to a total number of pixel elements on a display panel. Each of the intra-pixel circuits is located inside one of pixel elements and includes a signal loading module 20, a driving transistor Td and an organic light emitting diode, and as illustrated in FIG. 3, m organic light emitting diode D1, D2, . . . , D(m−1), and Dm are respectively connected to the m intra-pixel circuits.

A first terminal 11 of the external circuit 10 receives a first power supply signal Vdd, and a second terminal 12 of the external circuit 10 is connected respectively with sources of the driving transistors Td of the m intra-pixel circuits;

A first terminal 21 of each of the signal loading module 20 receives the first power supply signal Vddt, a second terminal 22 of the signal loading module 20 is connected with the source of the driving transistor Td in the intra-pixel circuit including the signal loading module 20, a third terminal 23 of the signal loading module 20 is connected with a gate of the driving transistor Td, a fourth terminal 24 of the signal loading module 20 is connected with a drain of the driving transistor Td, a fifth terminal 25 of the signal loading module 20 is connected with an anode of the organic light emitting diode in the intra-pixel circuit including the signal loading module 20, a cathode of the organic light emitting diode receives a second power supply signal Vss, and a sixth terminal 26 of the signal loading module 20 receives an image data signal Data. The m pixel elements where the m intra-pixel circuits are located are connected respectively with a plurality of different data lines which provide the corresponding pixel elements respectively with the image data signals. As illustrated in FIG. 3, the image data signals Data1, Data2, . . . , Data(m−1) and Datam provided respectively on the different data lines are received correspondingly at the sixth terminals 26 of the signal loading modules 20 of the m intra-pixel circuits. Each of the signal loading modules 20 is configured, in the signal loading phase, to load the image data signal Data received by the sixth terminal 26 of the signal loading module 20 to the source of the driving transistor Td of the intra-pixel circuit including the signal loading module 20 by the second terminal 22 of the signal loading module 20, to have the third terminal 23 of the signal loading module 20 connected with the fourth terminal 24 of the signal loading module 20 to generate and store a drive signal, and to have the fourth terminal of the signal loading module 20 disconnected from the fifth terminal 25 of the signal loading module 20; and in the light emitting phase, to have the third terminal 23 of the signal loading module 20 disconnected from the fourth terminal 24 of the signal loading module 20, to have the fourth terminal 24 of the signal loading module 20 connected with the fifth terminal 25 of the signal loading module 20, and to control the driving transistor Td by the drive signal stored in the signal loading phase and the signal at the source of the driving transistor Td to drive the organic light emitting diode of the intra-pixel circuit including the signal loading module 20 to emit light.

The external circuit 10 is configured to have the first terminal 11 of the external circuit 10 disconnected from the second terminal 12 of the external circuit 10 in the signal loading phase, and to have the first terminal 11 of the external circuit 10 connected with the second terminal 12 of the external circuit 10 in the light emitting phase.

The organic light emitting diode pixel driving circuit according to the first embodiment of the invention includes an external circuit and m intra-pixel circuits. An operation principle of the organic light emitting diode pixel driving circuit will be described below with reference to FIG. 4, which only illustrates two of the intra-pixel circuits as an example, but an operation principle of each of the m intra-pixel circuits is the same as the operation principle of the two intra-pixel circuits.

Figure 4:
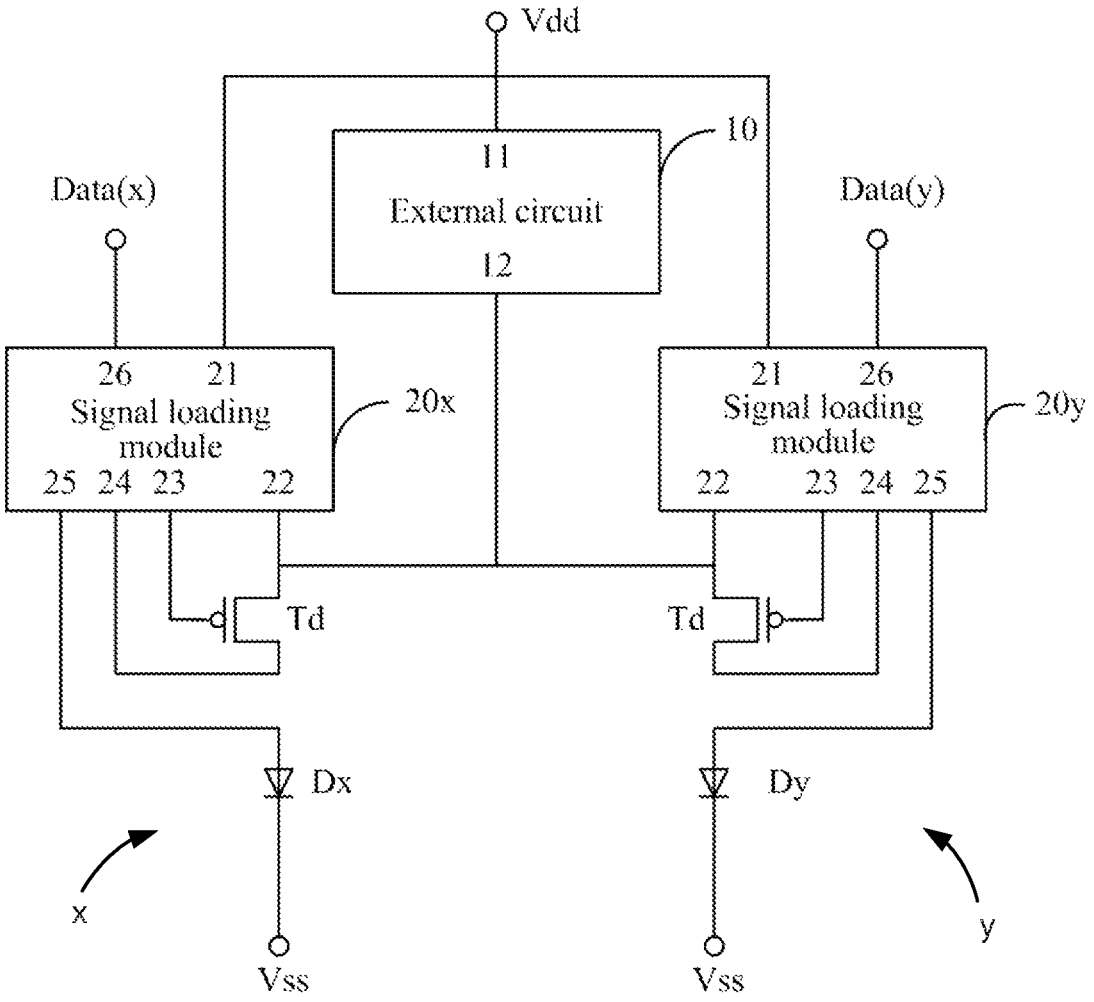
FIG. 4 is a simplified block diagram of the organic light emitting diode pixel driving circuit according to the first embodiment of the invention.

As illustrated in FIG. 4, the organic light emitting diode pixel driving circuit according to the first embodiment of the invention includes an external circuit 10, a first intra-pixel circuit x and a second intra-pixel circuit y, where the first intra-pixel circuit x and the second intra-pixel circuit y are any two different ones of the m intra-pixel circuits. The first intra-pixel circuit x includes a signal loading module 20*x*, a driving transistor Td and an organic light emitting diode Dx; and the second intra-pixel circuit y includes a signal loading module 20*y*, a driving transistor Td and an organic light emitting diode Dy.

First terminals 21 of the signal loading module 20*x* and the signal loading module 20*y* respectively receive a first power supply signal Vdd. A second terminal 22 of the signal loading module 20*x* is connected with a source of a driving transistor Td of the first intra-pixel circuit x, a third terminal of the signal loading module 20*x* is connected with a gate of the driving transistor Td, a fourth terminal 24 of the signal loading module 20*x* is connected with a drain of the driving transistor Td, a fifth terminal of the signal loading module 20*x* is connected with an anode of an organic light emitting diode Dx, a cathode of the organic light emitting diode Dx receives a second power supply signal Vss, and a sixth terminal 26 of the signal loading module 20*x* receives an image data signal Data(x).

Similarly, a second terminal 22 of the signal loading module 20*y* is connected with a source of a driving transistor Td of the second intra-pixel circuit y, a third terminal of the signal loading module 20*y* is connected with a gate of the driving transistor Td, a fourth terminal 24 of the signal loading module 20*y* is connected with a drain of the driving transistor Td, a fifth terminal of the signal loading module 20*y* is connected with an anode of an organic light emitting diode Dy, a cathode of the organic light emitting diode Dy receives the second power supply signal Vss, and a sixth terminal 26 of the signal loading module 20*y* receives an image data signal Data(y).

A first terminal 11 of the external circuit 10 receives a first power supply signal Vdd, and a second terminal of the external circuit 10 is connected respectively with the source of the driving transistor Td of the first intra-pixel circuit x and the source of the driving transistor Td of the second intra-pixel circuit y.

In a signal loading phase, the image data signal Data(x) is received by the sixth terminal 26 of the signal loading module 20*x* of the first intra-pixel circuit x and loaded to the source of the driving transistor Td of the first intra-pixel circuit x by the second terminal 22 of the signal loading module 20*x*, so the value of the source voltage Vs(x) of the driving transistor Td is Vdata(x) in the signal loading phase. The signal loading module 20*x* has the third terminal 23 of the signal loading module 20*x* connected with the fourth terminal 24 of the signal loading module 20*x*, that is, has the gate connected with the drain of the driving transistor Td, in the signal loading phase, so the gate voltage Vg(x) of the driving transistor Td is the sum of the source voltage Vs(x) thereof and the threshold voltage Vth(x) thereof, that is:

$$Vg(x)=Vs(x)+Vth(x)=V\mathrm{data}(x)+Vth(x) \quad (1\text{-}1)$$

That is, the voltage Vg(x) of a drive signal generated and stored by the signal loading module 20*x* of the first intra-pixel circuit x in the signal loading phase is Vdata(x)+Vth (x).

The signal loading module 20*x* of the first intra-pixel circuit x further has the fourth terminal 24 of the signal loading module 20*x* disconnected from the fifth terminal 25 of the signal loading module 20*x* in the signal loading phase so that the organic light emitting diode Dx does not emit light in the signal loading phase.

After the first intra-pixel circuit x has been loaded the image data signal in the signal loading phase, next the second intra-pixel circuit y starts to load the image data signal. Similarly, the gate voltage Vg(y) of the driving transistor Td of the second intra-pixel circuit y in the signal loading phase is:

$$Vg(y)=Vs(y)+Vth(y)=V\mathrm{data}(y)+Vth(y) \quad (2\text{-}1)$$

Where Vs(y) is the source voltage of the driving transistor Td of the second intra-pixel circuit y, Vth(y) is the threshold voltage of the driving transistor Td, and Vdata(y) is the voltage of the image signal received by the source of the driving transistor Td.

In a light emitting phase, the third terminal 23 of the signal loading module 20*x* of the first intra-pixel circuit x is disconnected from the fourth terminal 24 thereof, that is, the gate of the driving transistor Td of the first intra-pixel circuit x is disconnected from the drain thereof, and the fourth terminal 24 is connected with the fifth terminal 25, that is, the drain of the driving transistor Td of the first intra-pixel circuit x is connected with the anode of the organic light emitting diode Dx, so that the organic light emitting diode Dx can be driven by the drain current of the driving transistor Td to emit light. Also the first terminal 11 of the external circuit 10 is connected with the second terminal 12 thereof, so in the light emitting phase, the value of the source voltage Vs(x) of the driving transistor Td of the first intra-pixel circuit x is Vdd, and the drain current I(x) of the driving transistor Td of the first intra-pixel circuit x is:

$$I(x) = \frac{1}{2}k(Vg(x) - Vs(x) - Vth(x))^2 = \frac{1}{2}k(Vdata(x) - Vdd)^2 \quad (1\text{-}2)$$

Where k is a constant. As is apparent from Equation (1-2), the drain current I(x) of the driving transistor Td of the first intra-pixel circuit x is independent from the threshold voltage Vth(x) of the driving transistor Td.

Also the third terminal 23 of the second intra-pixel circuit y is disconnected from the fourth terminal 24 thereof, and the fourth terminal 24 of the second intra-pixel circuit y is connected with the fifth terminal 25 thereof, and the first terminal 11 of the external circuit 10 is connected with the second terminal 12 thereof, so the drain current I(y) of the driving transistor Td of the second intra-pixel circuit y is:

$$I(y) = \frac{1}{2}k(Vg(y) - Vs(y) - Vth(y))^2 = \frac{1}{2}k(Vdata(y) - Vdd)^2 \quad (2\text{-}2)$$

Where I(y) is the drain current of the driving transistor Td, k is a constant, Vg(y) is the gate voltage of the driving transistor Td, Vs(y) is the source voltage of the driving transistor Td, and Vth(y) is the threshold voltage of the driving transistor Td. As is apparent from Equation (2-2), the drain current I(y) of the driving transistor Td of the second intra-pixel circuit y is also independent from the threshold voltage Vth(y) of the driving transistor Td.

FIG. 4 illustrates the operation principle of the organic light emitting diode pixel driving circuit, which only illustrates two of the intra-pixel circuits as an example, and since the structure and the operating timing of each of the m intra-pixel circuits are the same as the two intra-pixel circuits illustrated in FIG. 4, and its operating principle is also the same as the operation principle of the two intra-pixel circuits, the operating principle of each of the m intra-pixel circuits can be appreciated by those skilled in the art, so a repeated description thereof will be omitted here.

In the organic light emitting diode pixel driving circuit according to the first embodiment of the invention, the m pixel elements sharing the same external circuit can be located in the same row of the display panel or can be located in different rows of the display panel or can be located in the same column of the display panel or can be located in different columns of the display panel or can be located in different rows and different columns of the display panel.

In the organic light emitting diode pixel driving circuit according to the first embodiment of the invention, for the m pixel elements sharing the same external circuit, the image data signals Data can be loaded sequentially to the intra-pixel circuits of the respective pixel elements, or the corresponding image data signals Data can be loaded to more than one of the intra-pixel circuits at a time, in the signal loading phase.

The drain current of each of the m driving transistors Td in the organic light emitting diode pixel driving circuit according to the first embodiment of the invention is independent from the threshold voltage Vth of the driving transistor Td, so with the organic light emitting diode pixel driving circuit according to the first embodiment of the invention, the non-uniformity of display due to the different threshold voltages of the plurality of driving transistors can be eliminated to thereby provide a better display effect.

The organic light emitting diode pixel driving circuit according to the first embodiment of the invention includes two components, one of which is the external circuit, and the other one of which is the intra-pixel circuits, where the external circuit can be shared by the m pixel elements. Each of the intra-pixel circuits is located in corresponding one of the pixel elements; and in order to drive one of the pixel elements, the intra-pixel circuit in the pixel element shall operate together with the external circuit shared by the pixel element to drive the pixel element to emit light. The number of devices in the pixel elements can be reduced and the size of the pixel elements can be shrunk in the organic light emitting diode pixel driving circuit according to the first embodiment of the invention, thereby making it particularly suitable for a display panel with high-resolution. Furthermore, the total number of devices in the pixel driving circuits on the display panel can be reduced and the size of the display panel can be reduced to further minimize a display device.

Figure 5:
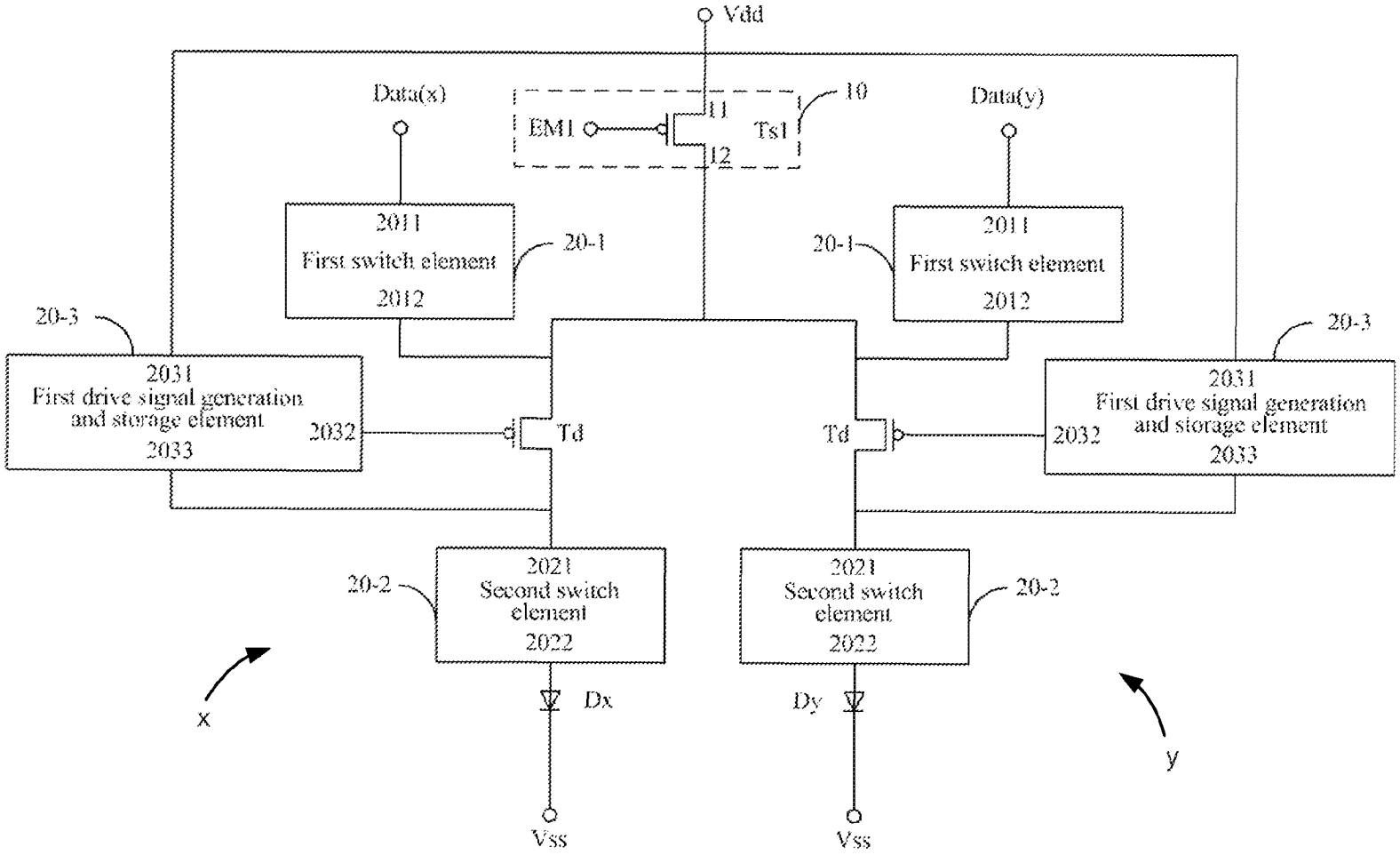
FIG. 5 is a simplified block diagram of an organic light emitting diode pixel driving circuit according to a second embodiment of the invention.

An organic light emitting diode pixel driving circuit according to a second embodiment of the invention includes an external circuit and a number m of intra-pixel circuits, each of intra-pixel circuits is located inside corresponding one of pixel elements, where m is an integer greater than or equal to 2 and smaller than or equal to the total number of pixel elements on a display panel. Each of the intra-pixel circuits includes a signal loading module, a driving transistor Td and an organic light emitting diode, and each of the signal loading modules includes a first switch element, a first drive signal generation and storage element and a second switch element. An operation principle of the organic light emitting diode pixel driving circuit will be described below in the second embodiment of the invention with reference to FIG. 5, which only illustrates two of the intra-pixel circuits as an example, and an operation principle of each of the m intra-pixel circuits is the same as the operation principle of the two intra-pixel circuits. As illustrated in FIG. 5, the organic light emitting diode pixel driving circuit according to the second embodiment of the invention includes a first intra-pixel circuit x and a second intra-pixel circuit y, where the first intra-pixel circuit x and the second intra-pixel circuit y are any two different ones of the m intra-pixel circuits.

The external circuit 10 includes a first switch transistor Ts1, where a first terminal 11 of the first switch transistor Ts1 is a first terminal of the external circuit 10, a gate of the first switch transistor Ts1 receives a light emitting control signal EM1, and a second terminal 12 of the first switch transistor Ts1 is a second terminal of the external circuit 10. The first switch transistor Ts1 is configured to be turned off in a signal loading phase so that no first power supply signal Vdd is received by sources of the driving transistors Td in the pixel elements sharing the external circuit; and to be turned on in a light emitting phase so that the first power supply signal Vdd can be loaded to the sources of the driving transistors Td in the pixel elements sharing the external circuit.

As illustrated in FIG. 5, each of the signal loading modules in the organic light emitting diode pixel driving circuit according to the second embodiment of the invention includes the first switch element 20-1, the second switch element 20-2 and the first drive signal generation and storage element 20-3. A first terminal 2011 of the first switch element 20-1 is a sixth terminal of the signal loading module, and a second terminal 2012 of the first switch element 20-1 is a second terminal of the signal loading module; a first terminal 2021 of the second switch element 20-2 is a fourth terminal of the signal loading module, and a second terminal 2022 of the second switch element 20-2 is a fifth terminal of the signal loading module; and a first terminal 2031 of the first drive signal generation and storage element 20-3 is a first terminal of the signal loading module, a second terminal 2032 of the first drive signal generation and storage element 20-3 is a third terminal of the signal loading module, and a third terminal 2033 is the fourth terminal of the signal loading module.

The first switch element 20-1 is configured to transmit an image data signal Data received by the first terminal 2011 thereof to the source of the driving transistor Td in the same intra-pixel circuit by the second terminal 2012 thereof in the signal loading phase, and to stop receiving the image data signal Data in the light emitting phase. It shall be noted that the first switch elements 20-1 of the m intra-pixel circuits are turned on sequentially to transmit the image data signals and turned off after the transmission of the image data signals are completed in the signal loading phase.

The second switch element 20-2 is configured to have the first terminal 2021 thereof disconnected from the second terminal 2022 thereof in the signal loading phase so that the organic light emitting diode does not emit light in the signal loading phase, and to have the first terminal 2021 connected with the second terminal 2022 thereof in the signal loading phase so that the organic light emitting diode is driven by the drain current of the driving transistor Td to emit light.

The first drive signal generation and storage element 20-3 is configured to have the second terminal 2020 connected with the third terminal 2033, thereby generating a drive signal from the signal at the source of the driving transistor Td in the intra-pixel circuit including the signal loading module 20-3 and store the drive signal in the signal loading phase, and to control the driving transistor Td by the stored drive signal to drive the organic light emitting diode to emit light in the light emitting phase.

Figure 6:
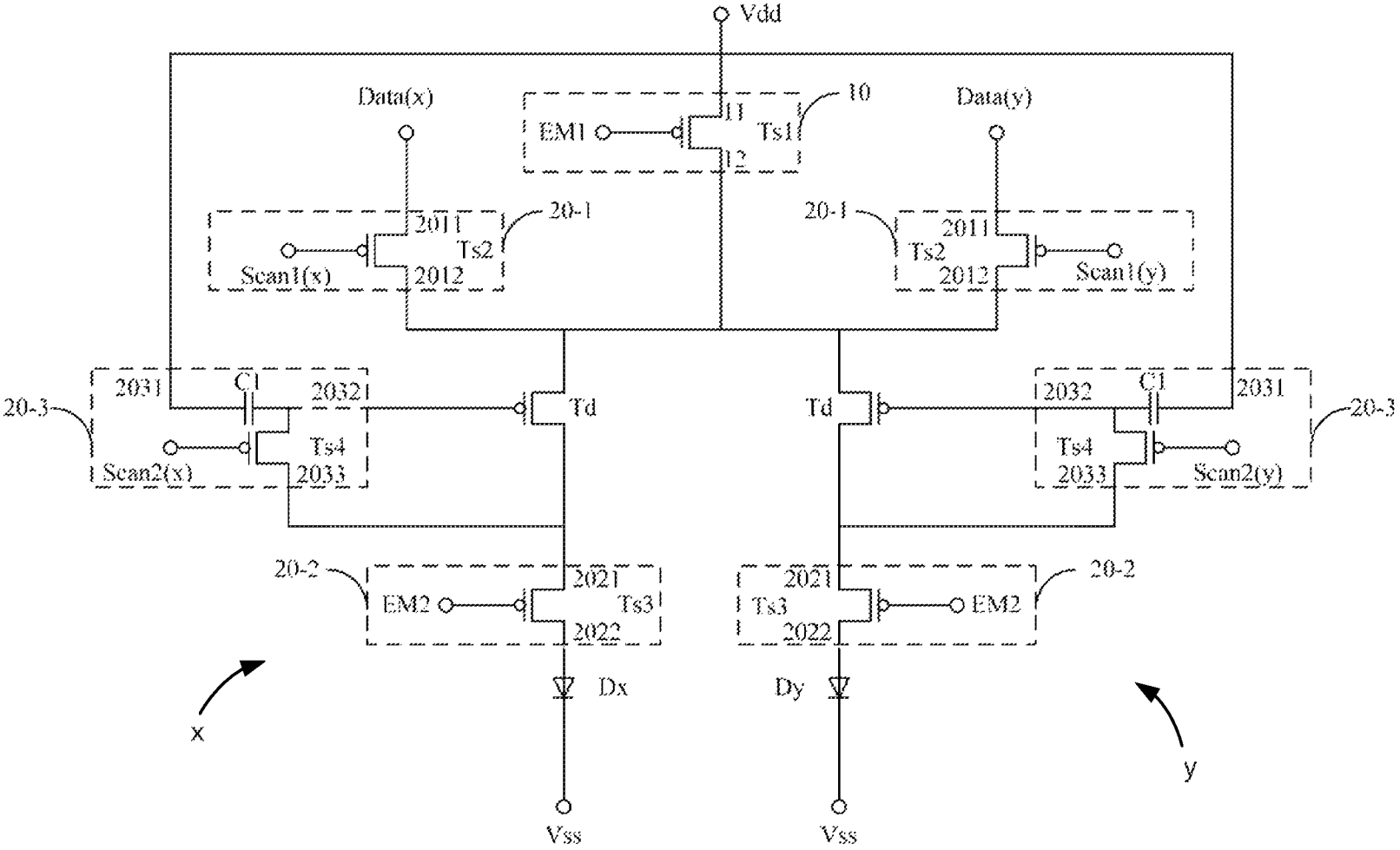
FIG. 6 is a simplified block diagram of an organic light emitting diode pixel driving circuit according to a third embodiment of the invention.

An organic light emitting diode pixel driving circuit according to a third embodiment of the invention includes an external circuit and a number m of intra-pixel circuits, each of intra-pixel circuits is located inside corresponding one of pixel elements, where m is an integer greater than or equal to 2 and smaller than or equal to the total number of pixel elements on a display panel. An operation principle of the organic light emitting diode pixel driving circuit will be described below in the third embodiment of the invention with reference to FIG. 6, which only illustrates two of the intra-pixel circuits as an example, and an operation principle of each of the m intra-pixel circuits is the same as the operation principle of the two intra-pixel circuits. As illustrated in FIG. 6, the organic light emitting diode pixel driving circuit according to the third embodiment of the invention includes a first intra-pixel circuit x and a second intra-pixel circuit y, where the first intra-pixel circuit x and the second intra-pixel circuit y are any two different ones of the m intra-pixel circuits.

The external circuit 10 in the organic light emitting diode pixel driving circuit according to the third embodiment of the invention includes a first switch transistor Ts1, where a first terminal 11 of the first switch transistor Ts1 is a first terminal of the external circuit 10, a gate of the first switch transistor Ts1 receives a light emitting control signal EM1, and a second terminal 12 of the first switch transistor Ts1 is a second terminal of the external circuit 10. The first switch transistor Ts1 is configured to be turned on in a light emitting phase so that a first power supply signal Vdd can be loaded to sources of the driving transistors Td in the pixel elements sharing the external circuit, and to be turned off in a signal loading phase so that no first power supply signal Vdd is received by the sources of the driving transistors Td in the pixel elements sharing the external circuit.

The first switch element 20-1 includes a second switch transistor Ts2, where a first terminal 2011 of the second switch transistor Ts2 is a first terminal of the first switch element 20-1, a gate of the second switch transistor Ts2 receives a first scan signal Scan1, and a second terminal 2012 of the second switch transistor Ts2 is a second terminal of the first switch element 20-1; and the second switch transistor Ts2 is configured to load an image data signal Data to the source of the driving transistor Td in the signal loading phase.

The second switch element 20-2 includes a third switch transistor Ts3, where a first terminal 2021 of the third switch transistor Ts3 is a first terminal of the second switch element 20-2, a gate of the third switch transistor Ts3 receives a second light emitting control signal EM2, and a second terminal 2022 of the third switch transistor Ts3 is a second terminal of the second switch element 20-2; and the third switch transistor Ts3 is configured to be turned on in the light emitting phase to thereby to drive an organic light emitting diode by a drain current of the driving transistor Td to emit light, and to be turned off in the signal loading phase.

The first drive signal generation and storage element 20-3 includes a first capacitor C1 and a fourth switch transistor Ts4, where a first terminal 2031 of the first capacitor C1 is a first terminal of the first drive signal generation and storage element 20-3, and a second terminal 2032 of the first capacitor C1 is a second terminal of the first drive signal generation and storage element 20-3, and a first terminal 2032 of the fourth switch transistor Ts4 is the second terminal of the first drive signal generation and storage element 20-3, a gate of the fourth switch transistor Ts4 receives a second scan signal Scan2, and a second terminal 2033 of the fourth switch transistor Ts4 is a third terminal of the first drive signal generation and storage element 20-3. The fourth switch transistor Ts4 is configured to be turned on in the signal loading phase to thereby read the threshold voltage Vth of the driving transistor Td. The first capacitor C1 is configured to store a drive signal generated in the signal loading phase.

Figure 7:
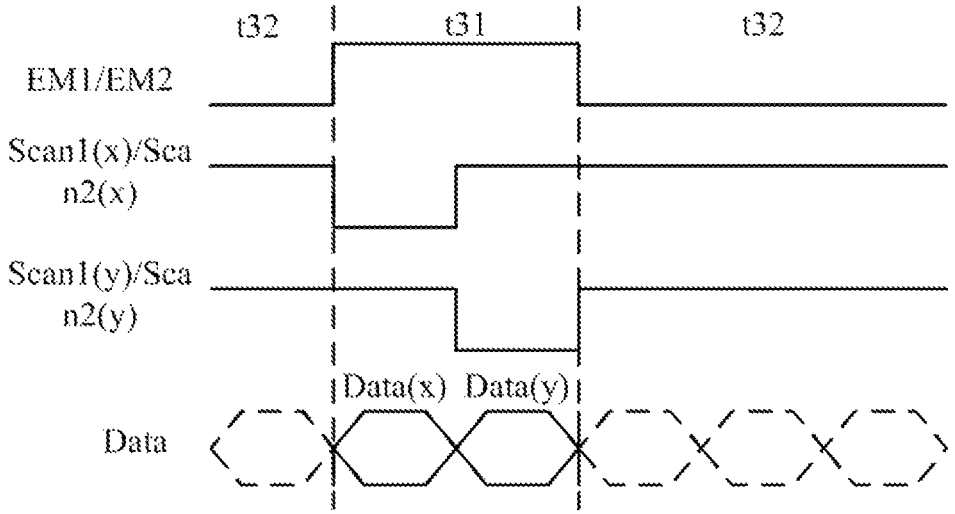
FIG. 7 is a first timing diagram of the organic light emitting diode pixel driving circuit according to the third embodiment of the invention in operation.

FIG. 7 illustrates a timing diagram of the organic light emitting diode pixel driving circuit according to the third embodiment of the invention in operation, where the first light emitting control signal EM1 is the same as the second light emitting control signal EM2, and the first scan signal Scan1 is the same as the second scan signal Scan2. There are two phases including the signal loading phase t31 and the light emitting phase t32. Within the signal loading phase t31, the first scan signal Scan1(*x*) of the first intra-pixel circuit x and the first scan signal Scan1(*y*) of the second intra-pixel circuit y are provided sequentially as enabling signals, and the second scan signal Scan2(*x*) of the first intra-pixel circuit x and the second scan signal Scan2(*y*) of the second intra-pixel circuit y are also provided sequentially as enabling signals.

In the signal loading phase t31, all the first switch transistor Ts1 and the two third switch transistors Ts3 in the organic light emitting diode pixel driving circuit illustrated in FIG. 6 are turned off; and firstly the first scan signal Scan1($x$) is provided as an enabling signal, and the second switch transistor Ts2 of the first intra-pixel circuit x is turned on, so the image data signal Data(x) is loaded to the source of the driving transistor Td of the first intra-pixel circuit x; and at this time the first scan signal Scan2($x$) is also provided as an enabling signal, and the fourth switch transistor Ts4 of the first intra-pixel circuit x is turned on, so a gate of the driving transistor Td of the first intra-pixel circuit x is connected with the drain thereof, and the gate voltage Vg(x) of the driving transistor Td is the sum of the source voltage Vs(x) thereof and the threshold voltage Vth(x) thereof, that is:

$$Vg(x)=Vs(x)+Vth(x)=V\text{data}(x)+Vth(x) \quad (1\text{-}1)$$

At this time the voltage of the drive signal stored in the first capacitor C1 of the first intra-pixel circuit x is equal to the value Vdata(x)+Vth(x) of the gate voltage of the driving transistor Td of the first intra-pixel circuit x.

Next the first scan signal Scan1($y$) is provided as an enabling signal, and the second switch transistor Ts2 of the second intra-pixel circuit y is turned on, so the image data signal Data(y) is loaded to the source of the driving transistor Td of the second intra-pixel circuit y; and at this time Scan2($y$) is also provided as an enabling signal, and the fourth switch transistor Ts4 of the second intra-pixel circuit y is turned on, so a gate of the driving transistor Td of the second intra-pixel circuit y is connected with the drain thereof, and the gate voltage Vg(y) of the driving transistor Td is the sum of the source voltage Vs(y) thereof and the threshold voltage Vth(y) thereof, that is:

$$Vg(y)=Vs(y)+Vth(y)=V\text{data}(y)+Vth(y) \quad (2\text{-}1)$$

At this time the voltage of the drive signal stored in the first capacitor C1 of the second intra-pixel circuit y is equal to the value Vdata(y)+Vth(y) of the gate voltage of the driving transistor Td of the second intra-pixel circuit y.

In the light emitting phase t32, the first light emitting control signal EM1 and the second light emitting control signal EM2 are provided as enabling signals, and all the first switch transistor Ts1 and the two third switch transistors Ts3 in the organic light emitting diode pixel driving circuit illustrated in FIG. 6 are turned on; the first scan signal Scan1 and the second scan signal Scan2 are provided as disabling signals, and both the second switch transistor Ts2 and the fourth switch transistor Ts4 are turned off; and as per the equation of a current characteristic of a transistor operating in a saturation region, the drain current I(x) of the driving transistor Td of the first intra-pixel circuit x is:

$$I(x)=\frac{1}{2}k(Vg(x)-Vs(x)-Vth(x))^2=\frac{1}{2}k(Vdata(x)-Vdd)^2 \quad (1\text{-}2)$$

The drain current I(x) of the driving transistor Td is independent from the threshold voltage Vth(x) thereof; and The drain current of the driving transistor Td of the second intra-pixel circuit y is:

$$I(y)=\frac{1}{2}k(Vg(y)-Vs(y)-Vth(y))^2=\frac{1}{2}k(Vdata(y)-Vdd)^2 \quad (2\text{-}2)$$

The drain current I(y) of the driving transistor Td is also independent from the threshold voltage Vth(y) thereof, so the non-uniformity of display due to the threshold voltages of the driving transistors can be eliminated in the organic light emitting diode pixel driving circuit according to the third embodiment of the invention.

In the organic light emitting diode pixel driving circuit according to the third embodiment of the invention, the m pixel elements sharing the same external circuit can be located in the same row of the display panel or can be located in different rows of the display panel or can be located in the same column of the display panel or can be located in different columns of the display panel or can be located in different rows and different columns of the display panel.

In the organic light emitting diode pixel driving circuit according to the third embodiment of the invention, the image data signals Data of the m pixel elements sharing the same external circuit can be loaded sequentially to the intra-pixel circuits of the respective pixel elements, or the corresponding image data signals Data can be loaded to more than one of the intra-pixel circuits at a time, in the signal loading phase.

The drain current of each of the m driving transistors Td in the organic light emitting diode pixel driving circuit according to the third embodiment of the invention is independent from the threshold voltage Vth of the driving transistor Td, so the non-uniformity of display due to the different threshold voltages of the plurality of driving transistors can be eliminated to thereby provide a better display effect with the organic light emitting diode pixel driving circuit according to the third embodiment of the invention.

The organic light emitting diode pixel driving circuit according to the third embodiment of the invention includes two components, one of which is the external circuit, and the other one of which is the intra-pixel circuits, where the external circuit can be shared by the m pixel elements, and each of the intra-pixel circuits is located in a corresponding one of the pixel elements; and in order to drive one of the pixel elements, the intra-pixel circuit in the pixel element shall operate together with the external circuit shared by the pixel element to drive the pixel element to emit light. The number of devices in the pixel elements can be reduced and the size of the pixel elements can be shrunk in the organic light emitting diode pixel driving circuit according to the third embodiment of the invention, thereby making it particularly suitable for a high-resolution display panel. Furthermore, the total number of devices in the pixel driving circuits on the display panel can be reduced and the size of the display panel can be reduced to further minimize a display device.

Figure 8:
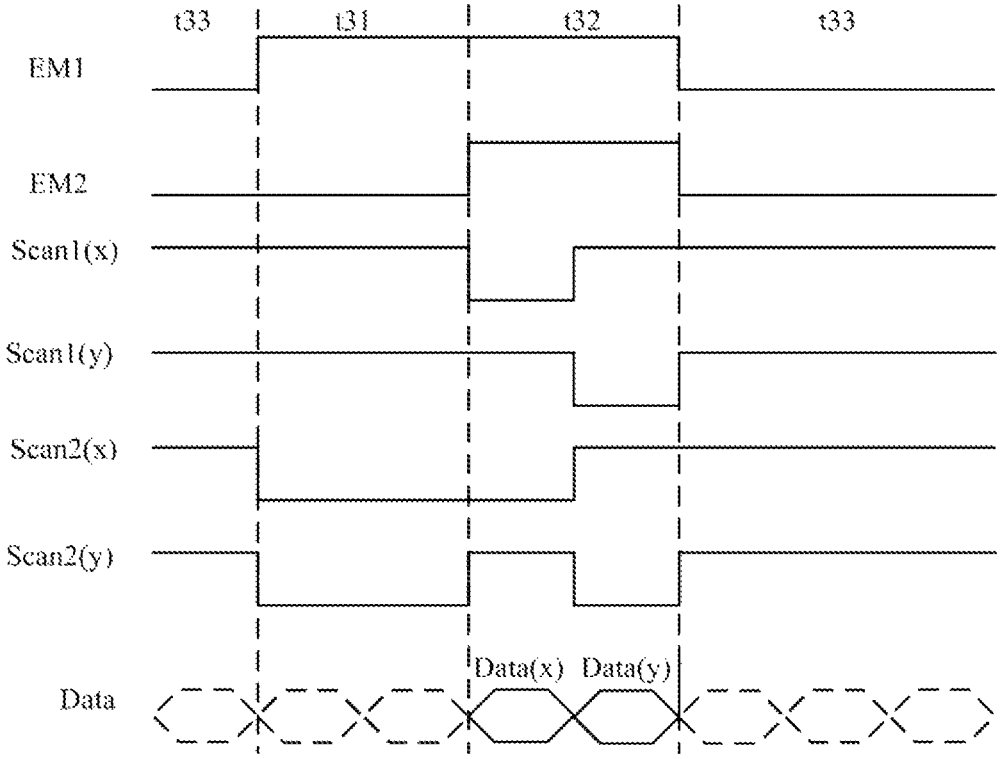
FIG. 8 is a second timing diagram of the organic light emitting diode pixel driving circuit according to the third embodiment of the invention in operation.

Alternatively FIG. 8 illustrates a timing diagram of the organic light emitting diode pixel driving circuit according to the third embodiment of the invention in operation, where there are three phases including an initialization phase t31, the signal loading phase t32 and the light emitting phase t33 in that order.

In the initialization phase t31 in FIG. 8:

The first scan signals Scan1($x$) and Scan1($y$) at a high level are provided as disabling signals, so both the second switch transistor Ts2 of the first intra-pixel circuit x and the second switch transistor Ts2 of the second intra-pixel circuit y are turned off;

The second scan signals Scan2($x$) and Scan2($y$) at a low level are provided as enabling signals, so both the fourth switch transistor Ts4 of the first intra-pixel circuit x and the fourth switch transistor Ts4 of the second intra-pixel circuit y are turned on;

The second light emitting control signal EM2 at a low level is provided as an enabling signal, so both the third switch transistor Ts3 of the first intra-pixel circuit x and the third switch transistor Ts3 of the second intra-pixel circuit y are turned on; and The first light emitting control signal EM1 at a high level is provided as a disabling signal, so the first switch transistor Ts1 of the external circuit is turned off.

Both the third switch transistor Ts3 and the fourth switch transistor Ts4 of the first intra-pixel circuit x are turned on, so the gate of the driving transistor Td of the first intra-pixel circuit x receives a second power supply signal Vss, that is, the gate of the driving transistor Td of the first intra-pixel circuit x is reset to Vss. Both the third switch transistor Ts3 and the fourth switch transistor Ts4 of the second intra-pixel circuit y are turned on, so the gate of the driving transistor Td of the second intra-pixel circuit y receives the second power supply signal Vss, that is, the gate of the driving transistor Td of the second intra-pixel circuit y is reset to Vss. Thus, an influence of a signal displayed in a previous frame on the display of a next frame of image can be avoided.

A condition of the organic light emitting diode pixel driving circuit according to the third embodiment of the invention operating in the signal loading phase t32 in FIG. 8 is the same as the condition of the organic light emitting diode pixel driving circuit according to the third embodiment of the invention operating in the signal loading phase in FIG. 7, so a repeated description thereof will be omitted here.

A condition of the organic light emitting diode pixel driving circuit according to the third embodiment of the invention operating in the light emitting phase t33 in FIG. 8 is the same as the condition of the organic light emitting diode pixel driving circuit according to the third embodiment of the invention operating in the light emitting phase in FIG. 7, so a repeated description thereof will be omitted here.

In the timing diagram illustrated in FIG. 8 of the organic light emitting diode pixel driving circuit according to the third embodiment of the invention in operation, the gate voltage of the driving transistor Td can be reset to the second power supply signal Vss in the initialization phase which precedes the signal loading phase to thereby avoid an influence of a signal displayed in a previous frame on the display of a next frame of image so as to achieve a better display effect.

Figure 9:
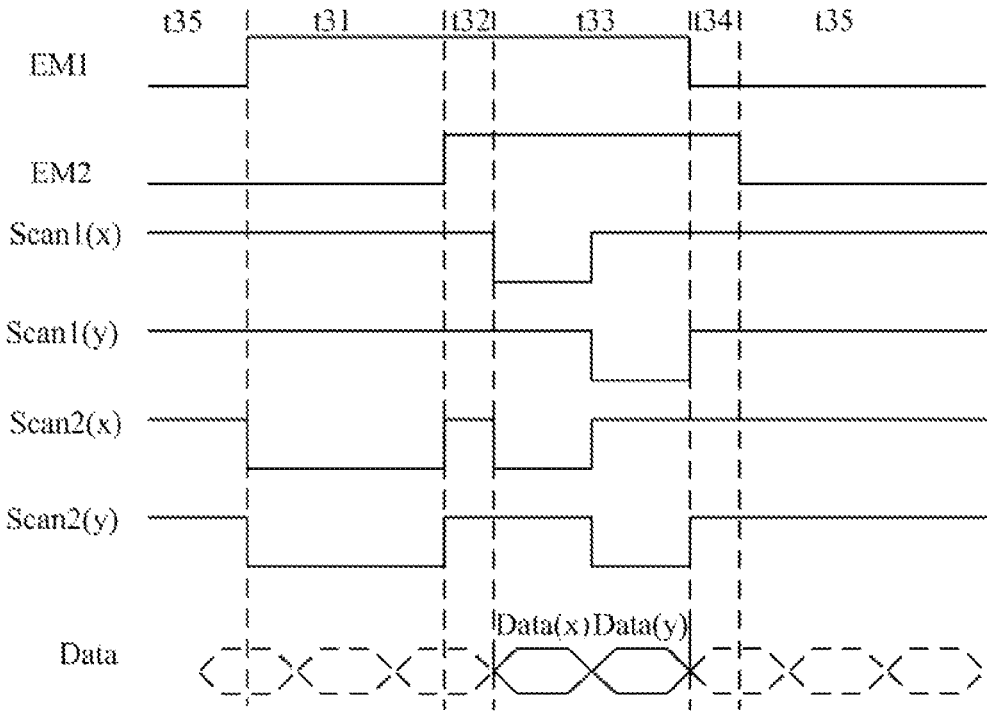
FIG. 9 is a third timing diagram of the organic light emitting diode pixel driving circuit according to the third embodiment of the invention in operation.

Alternatively, FIG. 9 illustrates another timing diagram of the organic light emitting diode pixel driving circuit according to the third embodiment of the invention in operation, where there are five phases including an initialization phase t31, a first wait phase t32, the signal loading phase t33, a second wait phase t34 and the light emitting phase t35 in that order.

A condition of the organic light emitting diode pixel driving circuit according to the third embodiment of the invention operating in the initialization phase t31 in FIG. 9 is the same as the condition of the organic light emitting diode pixel driving circuit according to the third embodiment of the invention operating in the initialization phase in FIG. 8, so a repeated description thereof will be omitted here.

In the first wait phase t32 in FIG. 9, the first scan signals Scan1($x$) and Scan1($y$) at a high level are provided as disabling signals, so the second switch transistor Ts2 of the first intra-pixel circuit x and the second switch transistor Ts2 of the second intra-pixel circuit y are turned off; the second scan signals Scan2($x$) and Scan2($y$) at a high level are provided as disabling signals, so the fourth switch transistor Ts4 of the first intra-pixel circuit x and the fourth switch transistor Ts4 of the second intra-pixel circuit y are turned off; the second light emitting control signal EM2 at a high level is provided as a disabling signal, so the third switch transistor Ts3 of the first intra-pixel circuit x and the third switch transistor Ts3 of the second intra-pixel circuit y are turned off; and the first light emitting control signal EM1 at a high level is provided as a disabling signal, so the first switch transistor Ts1 of the external circuit is turned off. With the first wait phase t32, the signal can be ensured to be further loaded after the third switch transistor Ts3 is turned off.

A condition of the organic light emitting diode pixel driving circuit according to the third embodiment of the invention operating in the signal loading phase t33 in FIG. 9 is the same as the condition of the organic light emitting diode pixel driving circuit according to the third embodiment of the invention operating in the signal loading phase in FIG. 8, so a repeated description thereof will be omitted here.

In the second wait phase t34 in FIG. 9, the first scan signals Scan1($x$) and Scan1($y$) are at a high level, so the second switch transistor Ts2 of the first intra-pixel circuit x and the second switch transistor Ts2 of the second intra-pixel circuit y are turned off; the second scan signals Scan2($x$) and Scan2($y$) at a high level are provided as disabling signals, so the fourth switch transistor Ts4 of the first intra-pixel circuit x and the fourth switch transistor Ts4 of the second intra-pixel circuit y are turned off; the second light emitting control signal EM2 at a high level is provided as a disabling signal, so the third switch transistor Ts3 of the first intra-pixel circuit x and the third switch transistor Ts3 of the second intra-pixel circuit y are turned off; and the first light emitting control signal EM1 at a low level is provided as an enabling signal, so the first switch transistor Ts1 of the external circuit is turned on. With the second wait phase t34, the pixel element can be ensured to emit light for display after the fourth switch transistor Ts4 is turned off.

A condition of the organic light emitting diode pixel driving circuit according to the third embodiment of the invention operating in the light emitting phase t35 in FIG. 9 will be the same as the condition of the organic light emitting diode pixel driving circuit according to the third embodiment of the invention operating in the light emitting phase in FIG. 7, so a repeated description thereof will be omitted here.

Figure 10:
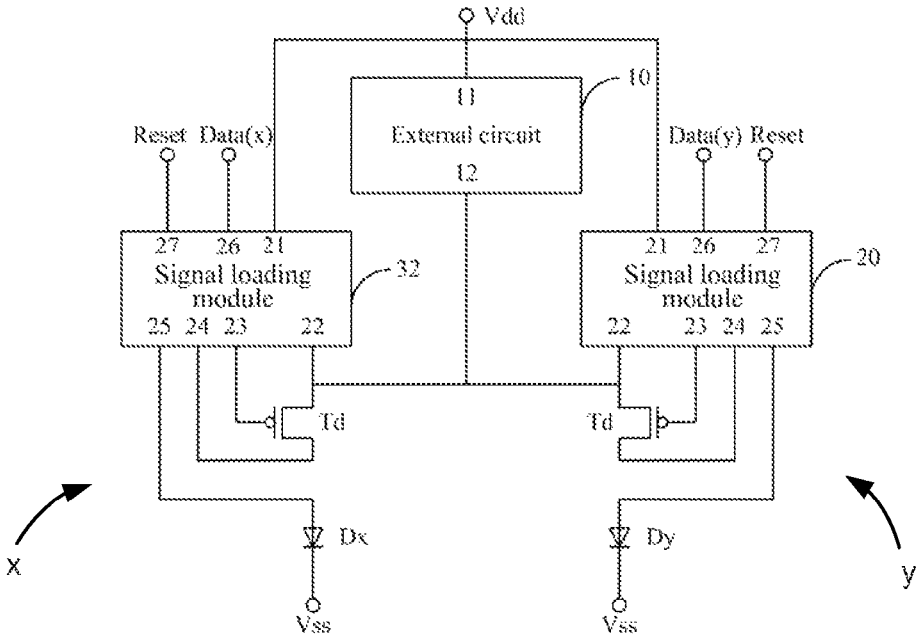
FIG. 10 is a simplified block diagram of an organic light emitting diode pixel driving circuit according to a fourth embodiment of the invention.

An organic light emitting diode pixel driving circuit according to a fourth embodiment of the invention includes an external circuit and a number m of intra-pixel circuits, where m is larger than or equal to 2 and smaller than or equal to the total number of pixel elements on a display panel, and each of the intra-pixel circuits includes a signal loading module, a driving transistor and an organic light emitting diode. An operation principle of the organic light emitting diode pixel driving circuit will be described below in the fourth embodiment of the invention with reference to FIG. 10, which only illustrates two of the intra-pixel circuits as an example, and an operation principle of each of the m intra-pixel circuits is the same as the operation principle of the two intra-pixel circuits. As illustrated in FIG. 10, the organic light emitting diode pixel driving circuit according to the fourth embodiment of the invention includes a first intra-pixel circuit x and a second intra-pixel circuit y, where the first intra-pixel circuit x and the second intra-pixel circuit y are any two different ones of the m intra-pixel circuits.

In addition to the functions of the organic light emitting diode pixel driving circuit according to the first embodiment of the invention, each of the signal loading modules 20 in the circuit illustrated in FIG. 10 is further configured to have the fourth terminal 24 of the signal loading module 20 disconnected from the fifth terminal 25 of the signal loading module 20 and transmit a reset signal Reset received by a seventh terminal 27 of the signal loading module 20 to the gate of the driving transistor Td in an initialization phase which precedes to the signal loading phase; and to stop receiving the reset signal Reset in the signal loading phase and the light emitting phase. The external circuit 10 is further configured to have the first terminal 11 of the external circuit 10 disconnected from the second terminal 12 thereof in the initialization phase.

The organic light emitting diode pixel driving circuit according to the fourth embodiment of the invention has the functions of the organic light emitting diode pixel driving circuit according to the first embodiment of the invention, so the organic light emitting diode pixel driving circuit according to the fourth embodiment of the invention also operates in the signal loading phase and the light emitting phase, and conditions of the organic light emitting diode pixel driving circuit according to the fourth embodiment of the invention operating in these two phases are the same as the conditions of the organic light emitting diode pixel driving circuit according to the first embodiment of the invention, so a repeated description thereof will be omitted here.

In the organic light emitting diode pixel driving circuit according to the fourth embodiment of the invention, the reset signal Reset received by the seventh terminal 27 of the signal loading module 20 can be transmitted to the gate of the driving transistor Td in the initialization phase to thereby eliminate an influence of a signal displayed in a previous frame on the display of a next frame of image so as to achieve a better display effect.

Figure 11:
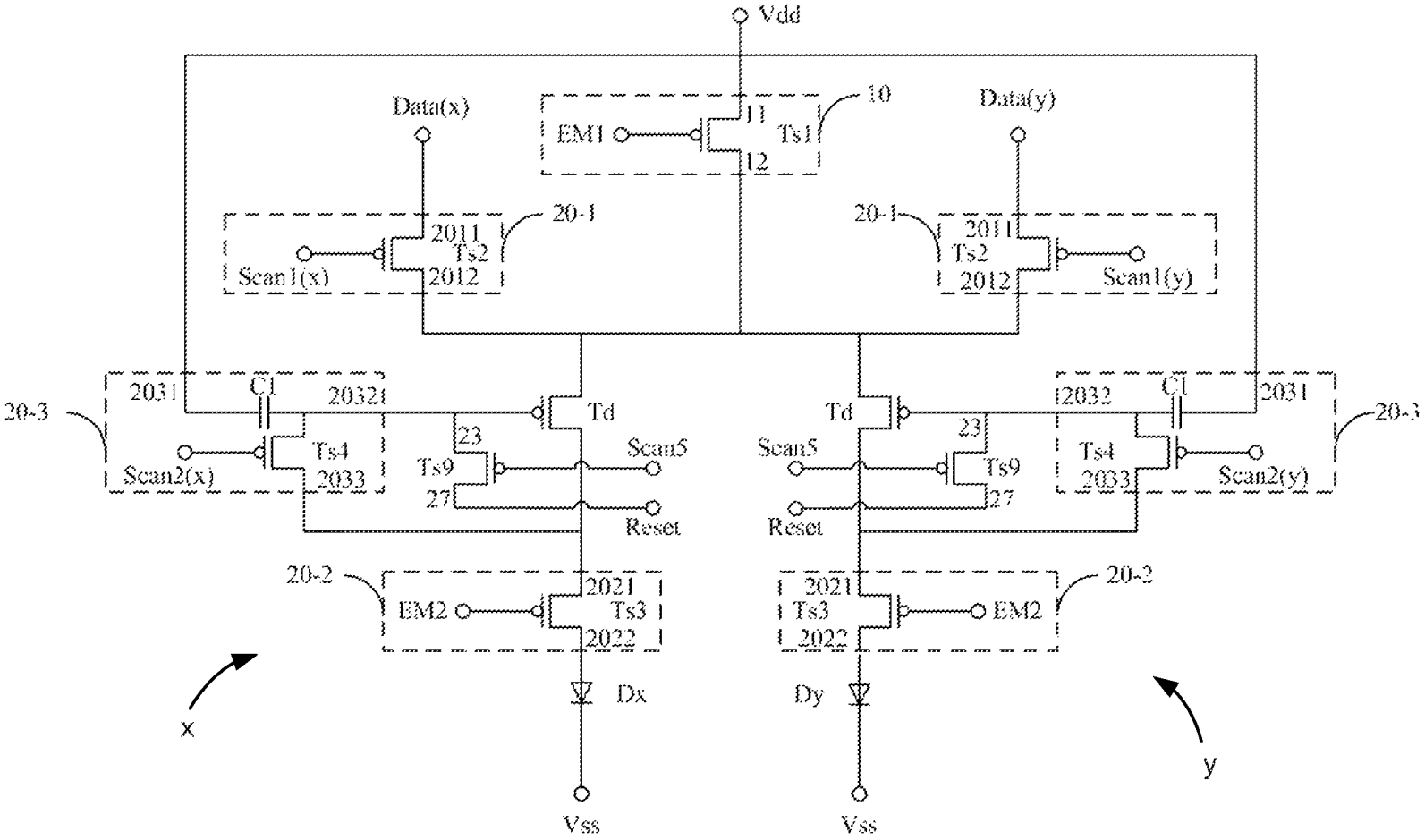
FIG. 11 is a simplified block diagram of an organic light emitting diode pixel driving circuit according to a fifth embodiment of the invention.

An organic light emitting diode pixel driving circuit according to a fifth embodiment of the invention includes an external circuit and a number m of intra-pixel circuits, where m is larger than or equal to 2 and smaller than or equal to the total number of pixel elements on a display panel. Each of the intra-pixel circuits includes a driving transistor, an organic light emitting diode, a second switch transistor, a third switch transistor, a fourth switch transistor and a ninth switch transistor. An operation principle of the organic light emitting diode pixel driving circuit will be described below in the fifth embodiment of the invention with reference to FIG. 11, which only illustrates two of the intra-pixel circuits as an example, and an operation principle of each of the m intra-pixel circuits is the same as the operation principle of the two intra-pixel circuits. As illustrated in FIG. 11, the organic light emitting diode pixel driving circuit according to the fifth embodiment of the invention includes a first intra-pixel circuit x and a second intra-pixel circuit y, where the first intra-pixel circuit x and the second intra-pixel circuit y are any two different ones of the m intra-pixel circuits.

As illustrated in FIG. 11, in addition to the functions of the organic light emitting diode pixel driving circuit according to the third embodiment of the invention, each of the intra-pixel circuits in the circuit illustrated in FIG. 11 further includes the ninth switch transistor Ts9, where a first terminal 27 of the ninth switch transistor Ts9 is a seventh terminal of the signal loading module 20-3, a gate of the ninth switch transistor Ts9 receives a fifth scan signal Scan5, and a second terminal 23 of the ninth switch transistor Ts9 is the third terminal of the signal loading module 20-3; and the ninth switch transistor Ts9 is configured to be turned on in the initialization phase to thereby load a reset signal Reset to the gate of the driving transistor Td, and to be turned off in the signal loading phase and the light emitting phase.

Figure 12:
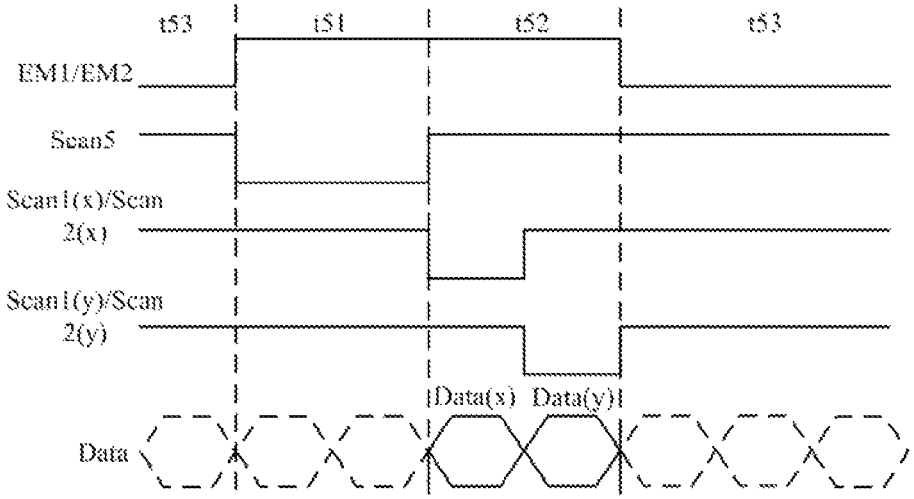
FIG. 12 is a timing diagram of the organic light emitting diode pixel driving circuit according to the fifth embodiment of the invention in operation.

FIG. 12 illustrates a timing diagram of the organic light emitting diode pixel driving circuit according to the fifth embodiment of the invention in operation, where the first light emitting control signal EM1 is the same as the second light emitting control signal EM2, and the first scan signal Scan1 is the same as the second scan signal Scan2; there are three phases including the initialization phase t51, the signal loading phase t52 and the light emitting phase t53.

In the initialization phase t51, the ninth switch transistor Ts9 in the organic light emitting diode pixel driving circuit according to the fifth embodiment of the invention is turned on, so the reset signal Reset can be loaded to the gate of the driving transistor Td to thereby eliminate an influence of a signal displayed in a previous frame on the display of a next frame of image.

In the signal loading phase t52, the ninth switch transistor Ts9 in the organic light emitting diode pixel driving circuit according to the fifth embodiment of the invention is turned off, so a function of the organic light emitting diode pixel driving circuit according to the fifth embodiment of the invention is the same as the function of the organic light emitting diode pixel driving circuit according to the third embodiment of the invention, so a repeated description thereof will be omitted here.

In the light emitting phase t53, the ninth switch transistor Ts9 in the organic light emitting diode pixel driving circuit according to the fifth embodiment of the invention is turned off, so a function of the organic light emitting diode pixel driving circuit according to the fifth embodiment of the invention will be the same as the function of the organic light emitting diode pixel driving circuit according to the third embodiment of the invention, so a repeated description thereof will be omitted here.

In the organic light emitting diode pixel driving circuit according to the fifth embodiment of the invention, the reset signal Reset can be loaded to the gate of the driving transistor Td through the ninth switch transistor Ts9 in the initialization phase to thereby eliminate an influence of a signal displayed in a previous frame on the display of a next frame of image so as to achieve a better display effect.

An organic light emitting diode pixel driving circuit according to a sixth embodiment of the invention includes an external circuit and a number m of intra-pixel circuits, each of intra-pixel circuits is located inside corresponding one of pixel elements and the m intra-pixel circuits are connected with the same data line, where m is an integer greater than or equal to 2 and smaller than or equal to the number of pixel elements connected with the same data line. Each of the intra-pixel circuit includes a driving transistor, an organic light emitting diode and a signal loading module.

The external circuit is configured to have a first terminal of the external circuit disconnected from a second terminal of the external circuit in a signal loading phase, to have the first terminal of the external circuit connected with the second terminal of the external circuit in a light emitting phase, to receive an image data signal Data by a third terminal of the external circuit, and to transmit the received image data signal Data sequentially to sources of the driving transistors of the m intra-pixel circuits by a fourth terminal of the external circuit in the signal loading phase; and Each of the signal loading modules is configured to have a third terminal of the signal loading module connected with a fourth terminal of the signal loading module, transmit the image data signal Data at the source of the driving transistor to a gate of the driving transistor, generate and store a drive signal, and have the fourth terminal of the signal loading module disconnected from a fifth terminal of the signal loading module, in a signal loading phase; and to have the third terminal of the signal loading module disconnected from the fourth terminal of the signal loading module, to have the fourth terminal of the signal loading module connected with the fifth terminal of the signal loading module, and to control the driving transistor by the drive signal stored in the signal loading phase and the signal at the source of the drive signal to drive the organic light emitting diode in the intra-pixel circuit including the signal loading module to emit light, in a light emitting phase.

It shall be noted that the third terminals and the fourth terminals of the m intra-pixel circuits are turned on sequentially in the signal loading phase so that the image data signal Data loaded to the sources of the driving transistors can be transmitted to the gates thereof, and the image data signal Data loaded to the sources of the driving transistors of the different intra-pixel circuits corresponds respectively to the respective m intra-pixel circuits. Particularly the third terminal of the first intra-pixel circuit is connected with the fourth terminal thereof, the image data signal Data1 is loaded to the source of the driving transistor of the first intra-pixel circuit, the signal loading module of the intra-pixel circuit generates and stores the voltage of the drive signal, the third terminal of the first intra-pixel circuit is disconnected from the fourth terminal thereof; the third terminal of the second intra-pixel circuit is connected with the fourth terminal thereof, the image data signal Data2 is loaded to the source of the driving transistor of the second intra-pixel circuit, the signal loading module of the second intra-pixel circuit generates and stores the voltage of the drive signal, and the third terminal of the second intra-pixel circuit is disconnected from the fourth terminal thereof; the third terminal of the (m−1)-th intra-pixel circuit is connected with the fourth terminal thereof, the image data signal Data(m−1) is loaded to the source of the driving transistor of the (m−1)-th intra-pixel circuit, the signal loading module of the (m−1)-th intra-pixel circuit generates and stores the voltage of the drive signal, and the third terminal of the (m−1)-th intra-pixel circuit is disconnected from the fourth terminal thereof and the third terminal of the m-th intra-pixel circuit is connected with the fourth terminal thereof, the image data signal Datam is loaded to the source of the driving transistor of the m-th intra-pixel circuit, the signal loading module of the m-th intra-pixel circuit generates and stores the voltage of the drive signal and the third terminal of the m-th intra-pixel circuit is disconnected from the fourth terminal thereof.

Figure 13:
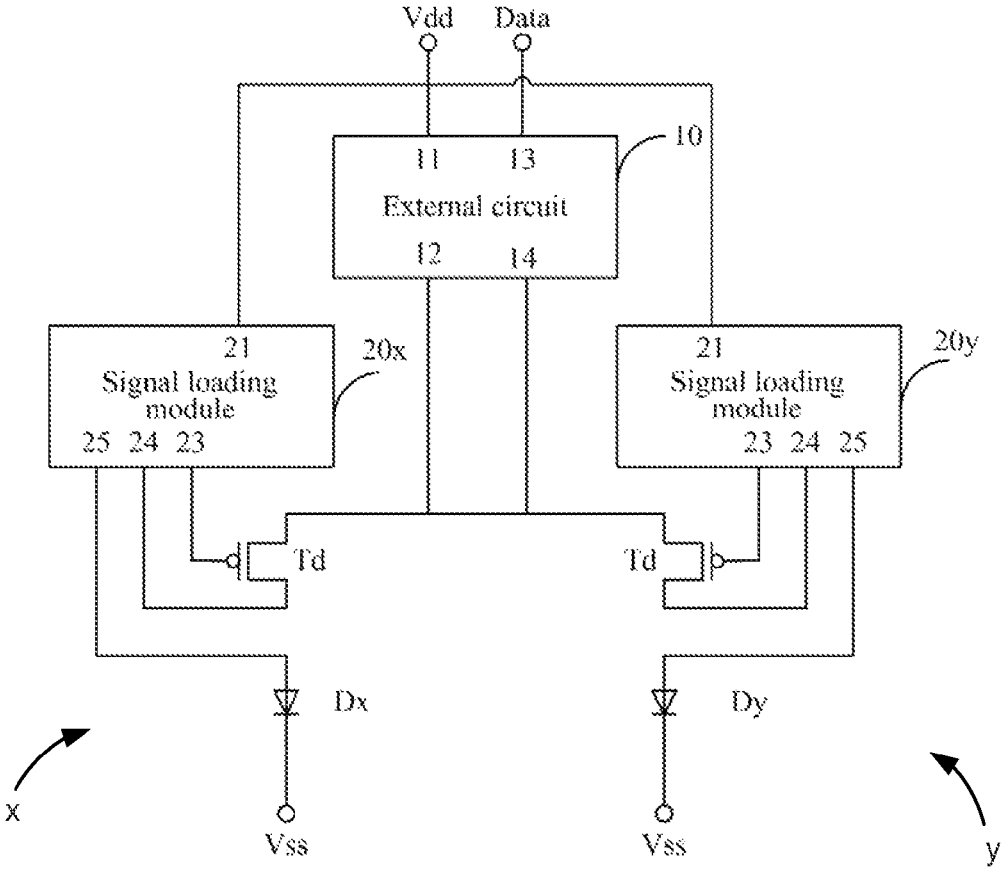
FIG. 13 is a simplified block diagram of an organic light emitting diode pixel driving circuit according to a sixth embodiment of the invention.

An operation principle of the organic light emitting diode pixel driving circuit will be described below in the sixth embodiment of the invention with reference to FIG. 13, which only illustrates two of the intra-pixel circuits as an example, and an operation principle of each of the m intra-pixel circuits is the same as the operation principle of the two intra-pixel circuits. As illustrated in FIG. 13, the organic light emitting diode pixel driving circuit according to the sixth embodiment of the invention includes a first intra-pixel circuit x and a second intra-pixel circuit y, where the first intra-pixel circuit x and the second intra-pixel circuit y are any two different ones of the m intra-pixel circuits. The signal loading module 20*x* of the first intra-pixel circuit x has the third terminal 23 thereof connected with the fourth terminal 24 thereof, that is, has the gate of the driving transistor Td connected with a drain of the driving transistor Td in the first intra-pixel circuit x, in the signal loading phase, so the gate voltage of the driving transistor Td of the first intra-pixel circuit x is the sum of the source voltage thereof and the threshold voltage thereof, that is:

$$Vg(x)=Vs(x)+Vth(x)=V\text{data}(x)+Vth(x) \tag{1-1}$$

That is, the voltage Vg(x) of the drive signal generated and stored by the signal loading module 20*x* of the first intra-pixel circuit x in the signal loading phase is Vdata(x)+Vth(x).

Where Vg(x) is the gate voltage of the driving transistor Td in the first intra-pixel circuit x, Vs(x) is the source voltage of the driving transistor Td, and Vth(y) is the threshold voltage of the driving transistor Td.

The signal loading module 20*x* of the first intra-pixel circuit x has the fourth terminal 24 thereof disconnected from the fifth terminal 25 thereof in the signal loading phase so that the organic light emitting diode Dx does not emit light in the signal loading phase; and the signal loading module 20*x* has the third terminal 23 thereof disconnected from the fourth terminal 24 thereof, that is, has the gain of the driving transistor Td of the first intra-pixel circuit x disconnected from the drain thereof in the light emitting phase; the first intra-pixel circuit x has the fourth terminal 24 of the signal loading module 20*x* connected with the fifth terminal 25 of the signal loading module 20*x*, that is, connects the drain of the driving transistor Td with an anode of the organic light emitting diode Dx, in the light emitting phase so that the organic light emitting diode Dx can be driven by the drain current of the driving transistor Td to emit light; and the first terminal 11 of the external circuit 10 is connected with the second terminal 12 thereof in the light emitting phase, so in the light emitting phase, the source the voltage Vs(x) of the driving transistor Td of the first intra-pixel circuit x is Vdd, and the drain current I(x) thereof is:

$$I(x)=\frac{1}{2}k(Vg(x)-Vs(x)-Vth(x))^2=\frac{1}{2}k(Vdata(x)-Vdd)^2 \tag{1-2}$$

As is apparent from Equation (1-2), the drain current I(x) of the driving transistor Td of the first intra-pixel circuit x is independent from the threshold voltage Vth(x) of the driving transistor Td.

Similarly, the drain current I(y) of the driving transistor Td of the second intra-pixel circuit y is also independent from the threshold voltage Vth(y) of the driving transistor Td of the second intra-pixel circuit y, so the non-uniformity of display due to the threshold voltages of the driving transistors can be eliminated in the organic light emitting diode pixel driving circuit according to the sixth embodiment of the invention.

The number of devices in the pixel elements can be reduced and the size of the pixel elements can be shrunk in the organic light emitting diode pixel driving circuit according to the sixth embodiment of the invention, thereby making it particularly suitable for a display panel with a high-resolution. Furthermore the total number of devices in the pixel driving circuits on the display panel can be lowered and the size of the display panel can be reduced to further minimize a display device.

The organic light emitting diode pixel driving circuit according to the sixth embodiment of the invention in the signaling load phase differs from the organic light emitting diode pixel driving circuit according to the first embodiment of the invention in the signal loading phase only in that the pixel elements, where the m intra-pixel circuits in the organic light emitting diode pixel driving circuit according to the first embodiment of the invention are located, may not be connected with the same data line, whereas the pixel elements, where the m intra-pixel circuits in the organic light emitting diode pixel driving circuit according to the sixth embodiment of the invention are located, are connected with the same data line to thereby further lower the number of devices constituting the organic light emitting diode pixel driving circuits in the display panel and make a design of wiring in the display panel simpler.

An organic light emitting diode pixel driving circuit according to a seventh embodiment of the invention includes an external circuit and a number m of intra-pixel circuits, each of intra-pixel circuits is located inside corresponding one of pixel elements and the m intra-pixel circuits are connected with the same data line, where m is an integer greater than or equal to 2 and smaller than or equal to the number of pixel elements connected with the same data line. Each of the intra-pixel circuits includes a second drive signal generation and storage element, a third switch element, a driving transistor and an organic light emitting diode. An operation principle of the organic light emitting diode pixel driving circuit will be described below in the seventh embodiment of the invention with reference to FIG. 14, which only illustrates two of the intra-pixel circuits as an example, and an operation principle of each of the m intra-pixel circuits is the same as the operation principle of the two intra-pixel circuits. The two intra-pixel circuits are any two different ones of the m intra-pixel circuits.

Figure 14:
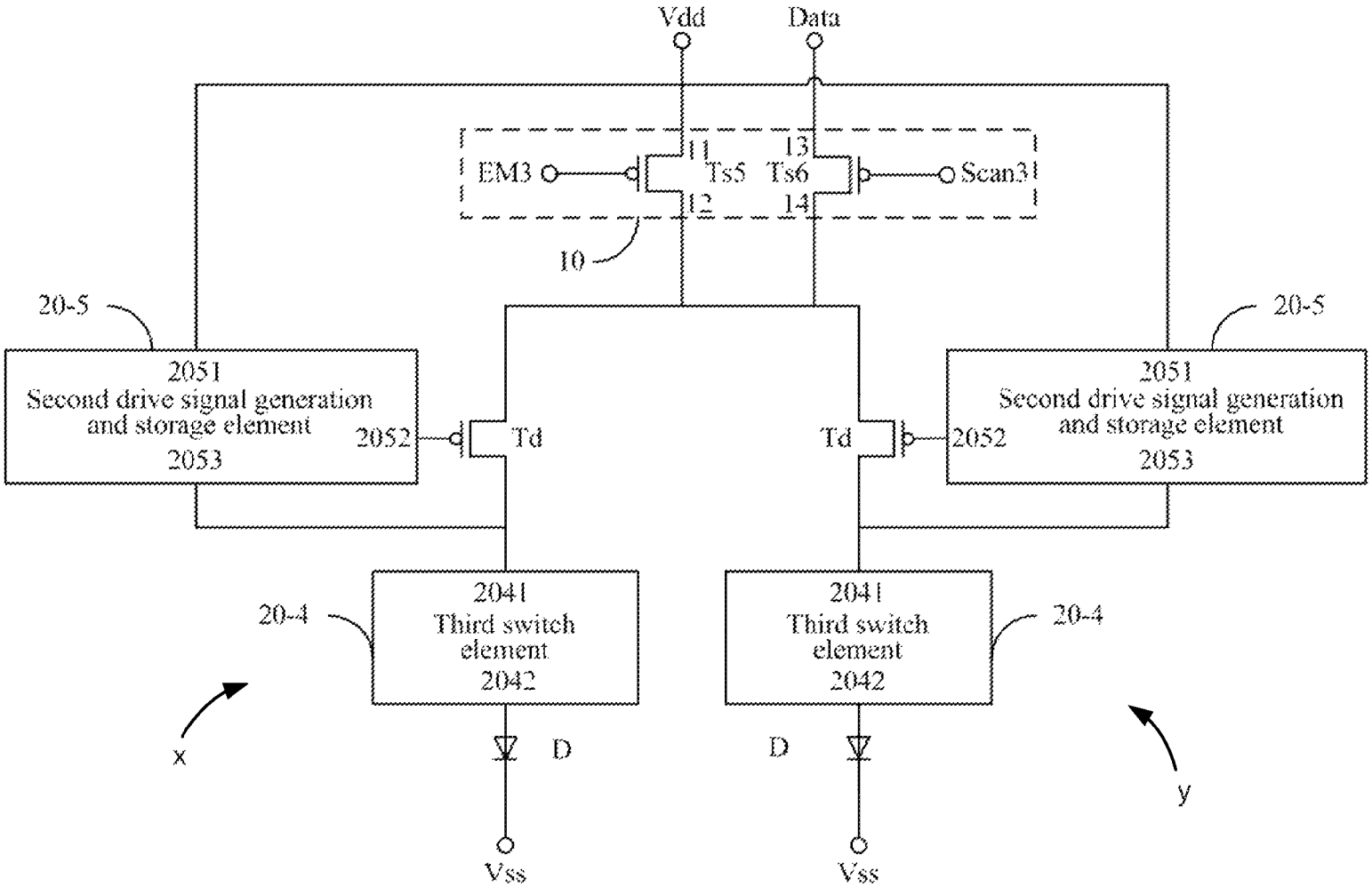
FIG. 14 is a simplified block diagram of an organic light emitting diode pixel driving circuit according to a seventh embodiment of the invention.

FIG. 14 is a schematic structural diagram of an organic light emitting diode pixel driving circuit according to a seventh embodiment of the invention. The external circuit 10 includes a fifth switch transistor Ts5 and a sixth switch transistor Ts6, where a first terminal 11 of the fifth switch transistor Ts5 is a first terminal of the external circuit 10, a gate of the fifth switch transistor Ts5 receives a third light emitting control signal EM3, and a second terminal 12 of the fifth switch transistor Ts5 is a second terminal of the external circuit 10; and a first terminal 13 of the sixth switch transistor Ts6 is a third terminal of the external circuit 10, a gate of the sixth switch transistor Ts6 receives a third scan signal Scan3, and a second terminal 14 of the sixth switch transistor Ts6 is a fourth terminal of the external circuit 10;

The fifth switch transistor Ts5 is configured to be turned off in a signal loading phase and to be turned on in a light emitting phase to thereby load a first power supply signal Vdd to sources of the m driving transistors Td; and The sixth switch transistor Ts6 is configured to be turned on in the signal loading phase to thereby transmit a corresponding image data signal Data sequentially to the sources of the driving transistors of the corresponding intra-pixel circuits; and to be turned off in the light emitting phase.

Each of the signal loading modules 20 in the organic light emitting diode pixel driving circuit illustrated in FIG. 14 includes the third switch element 20-4 and the second drive signal generation and storage element 20-5.

A first terminal 2041 of the third switch element 20-4 is a fourth terminal of the signal loading module 20, and a second terminal 2042 of the third switch element 20-4 is a fifth terminal of the signal loading module 20; and a first terminal 2051 of the second drive signal generation and storage element 20-5 is a first terminal of the signal loading module 20, a second terminal 2052 of the second drive signal generation and storage element 20-5 is a third terminal of the signal loading module 20, and a third terminal 2053 of the second drive signal generation and storage element 20-5 is the fourth terminal of the signal loading module 20.

The third switch element 20-4 is configured to have the first terminal 2041 of the third switch element 20-4 connected with the second terminal 2042 of the third switch element 20-4 in the light emitting phase, and to have the first terminal 2041 of the third switch element 20-4 disconnected from the second terminal 2042 of the third switch element 20-4 in the signal loading phase.

The second drive signal generation and storage element 20-5 is configured to have the second terminal 2052 of the second drive signal generation and storage element 20-5 connected with the third terminal 2053 of the second drive signal generation and storage element 20-5 in the signal loading phase to thereby generate a drive signal from the signal at the source of the driving transistor and store the drive signal; to have the second terminal 2052 of the second drive signal generation and storage element 20-5 disconnected from the third terminal 2053 of the second drive signal generation and storage element 20-5 in the remaining period of the signal loading phase and the light emitting phase; and to control the driving transistor by the stored drive signal to drive the organic light emitting diode D to emit light in the light emitting phase.

An organic light emitting diode pixel driving circuit according to an eighth embodiment of the invention includes an external circuit and a number m of intra-pixel circuits, each of intra-pixel circuits is located inside corresponding one of pixel elements and the m intra-pixel circuits are connected with the same data line, where m is larger than or equal to 2 and smaller than or equal to the number of pixel elements connected with the same data line. The external circuit includes a fifth switch transistor Ts5 and a sixth switch transistor Ts6, and each of the intra-pixel circuits includes a seventh switch transistor Ts7, a second capacitor C2, an eighth switch transistor Ts8, a driving transistor and an organic light emitting diode.

Figure 15:
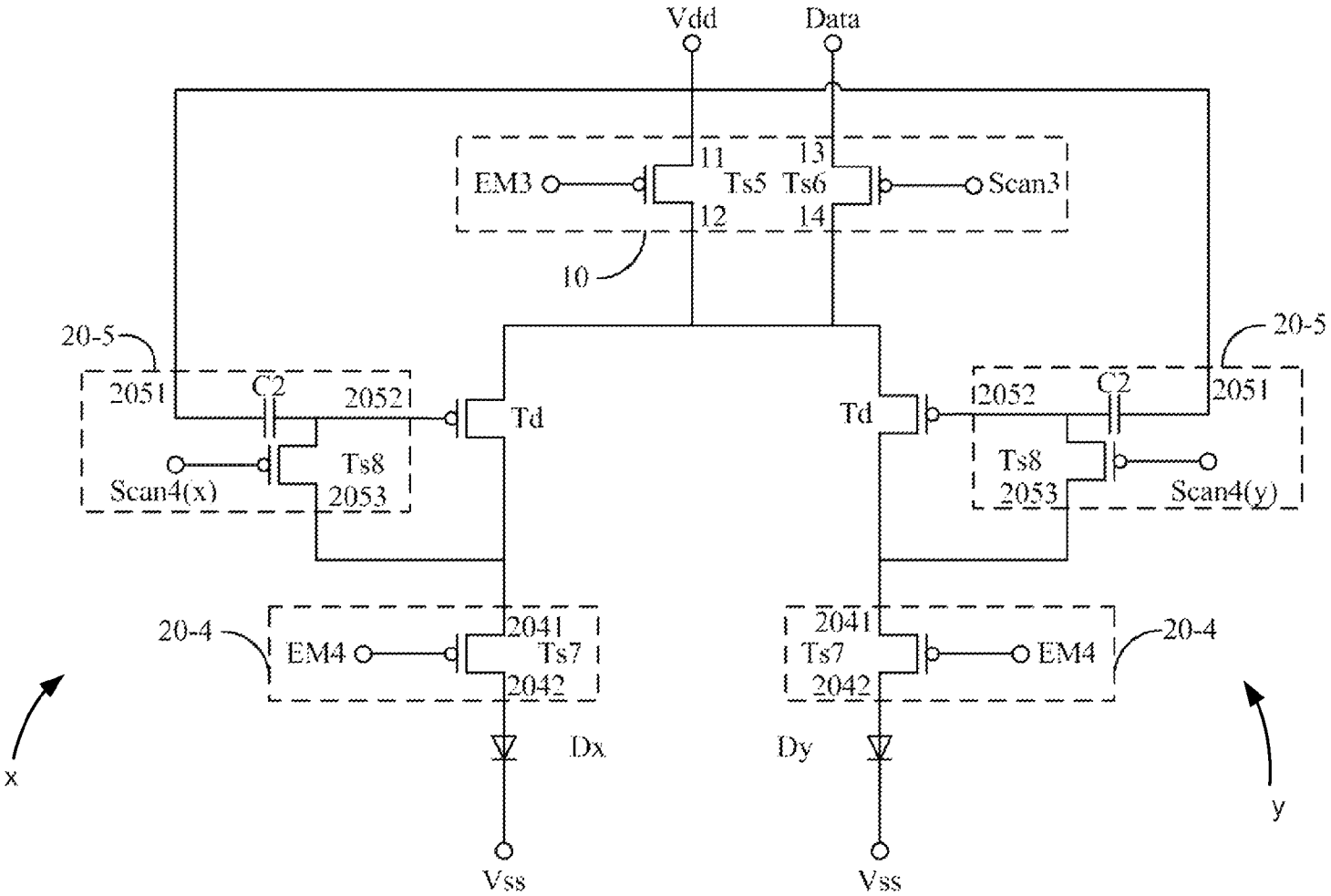
FIG. 15 is a simplified block diagram of an organic light emitting diode pixel driving circuit according to an eighth embodiment of the invention.

An operation principle of the organic light emitting diode pixel driving circuit will be described below in the eighth embodiment of the invention with reference to FIG. 15, which only illustrates two of the intra-pixel circuits as an example, and an operation principle of each of the m intra-pixel circuits is the same as the operation principle of the two intra-pixel circuits. As illustrated in FIG. 15, the organic light emitting diode pixel driving circuit according to the eighth embodiment of the invention includes a first intra-pixel circuit x and a second intra-pixel circuit y, where the first intra-pixel circuit x and the second intra-pixel circuit y are any two different ones of the m intra-pixel circuits.

A third switch element 20-4 of each of the intra-pixel circuits includes the seventh switch transistor Ts7, where a first terminal 2041 of the seventh switch transistor Ts7 is a first terminal of the third switch element 20-4, a gate of the seventh switch transistor Ts7 receives a fourth light emitting control signal EM4, and a second terminal 2042 of the seventh switch transistor Ts7 is a second terminal of the third switch element 20-4; and the seventh switch transistor Ts7 is configured to be turned on in a light emitting phase so that the organic light emitting diode can be driven by the drain current of the driving transistor Td to emit light, and to be turned off in a signal loading phase.

A second drive signal generation and storage element 20-5 of each of the intra-pixel circuits includes the second capacitor C2 and an eighth switch transistor Ts8. A first terminal 2051 of the second capacitor C2 is a first terminal 2051 of the second drive signal generation and storage element 20-5, and a second terminal 2052 of the second capacitor C2 is a second terminal of the second drive signal generation and storage element 20-5. A first terminal 2052 of the eighth switch transistor Ts8 is the second terminal of the second drive signal generation and storage element 20-5, a gate of the eighth switch transistor Ts8 receives a fourth scan signal (the gate of the eighth switch transistor Ts8 receives the fourth scan signal Scan4(*x*) in the first intra-pixel circuit x, and the gate of the eighth switch transistor Ts8 receives the fourth scan signal Scan4(*y*) in the first intra-pixel circuit y in FIG. 15), and a second terminal 2053 of the eighth switch transistor Ts8 is a third terminal of the second drive signal generation and storage element 20-5. The eighth switch transistor Ts8 is configured to be turned on in the signal loading phase so that the driving transistor Td is configured to generate a drive signal from an image data signal Data received from the external circuit 10 and to be turned off in the light emitting phase. The second capacitor C2 is configured to store the drive signal generated by the driving transistor Td. It shall be noted that the eighth switch transistors Ts8 of the m intra-pixel circuits are turned on sequentially to thereby receive the image data signal and turned off after the image data signal Data is received in the signal loading phase.

Figure 16:
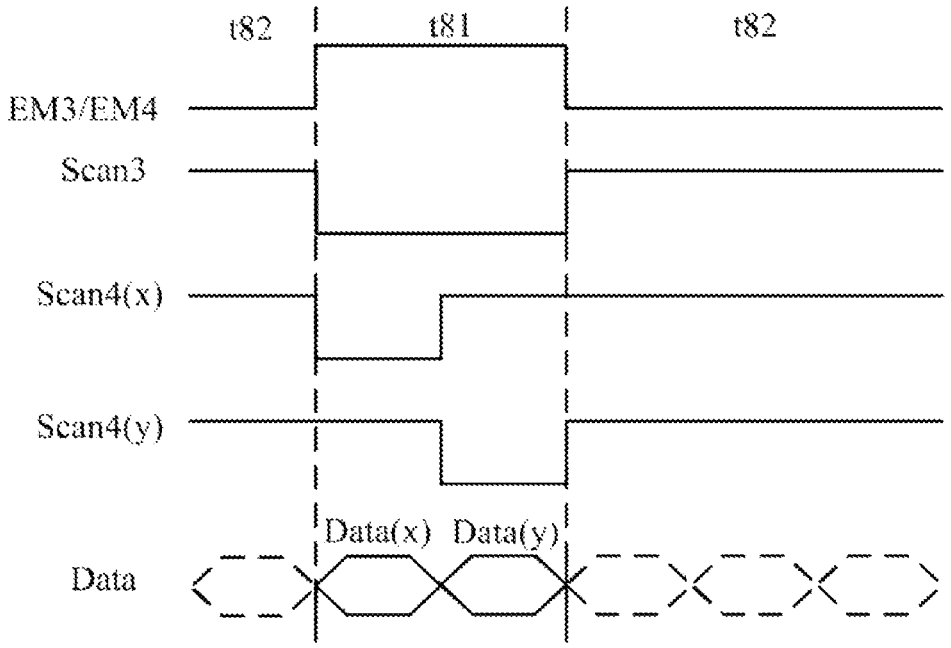
FIG. 16 is a first timing diagram of the organic light emitting diode pixel driving circuit according to the eighth embodiment of the invention in operation.

FIG. 16 illustrates a timing diagram of the organic light emitting diode pixel driving circuit according to the eighth embodiment of the invention in operation, where there are two phases including the signal loading phase t81 and the light emitting phase t82, and the third light emitting control EM3 is the same as the fourth light emitting control EM4.

In the signal loading phase t81, the third light emitting control EM3 and the fourth light emitting control EM4 at a high level are provided as disabling signals, and both the fifth switch transistor Ts5 and the seventh switch transistor Ts7 in the first intra-pixel circuit x are turned off; Scan3 at a low level is provided as an enabling signal, and the sixth switch transistor Ts6 of the first intra-pixel circuit x is turned on; and when Scan4(*x*) at a low level is provided as an enabling signal, the eight switch transistor Ts8 of the first intra-pixel circuit x is turned on. Thus a gate of the driving transistor Td of the first intra-pixel circuit x is connected with a drain thereof, and the driving transistor Td generates the drive signal at the gate thereof from the image data signal Data(x) loaded to the source thereof, where the voltage Vg(x) of the drive signal is:

$$Vg(x)=Vs(x)+Vth(x)=V\mathrm{data}(x)+Vth(x) \quad (1\text{-}1)$$

Where Vs(x) is the source voltage of the driving transistor Td of the first intra-pixel circuit x, Vth(x) is the threshold voltage of the driving transistor Td of the first intra-pixel circuit x, and Vdata(x) is the voltage of the image signal received by the driving transistor Td of the first intra-pixel circuit x; and the value of the voltage Vg(x) of the drive signal is stored in the first capacitor C1 of the first intra-pixel circuit x.

Similarly, in the signal loading phase t81, when Scan4(*y*) at a low level is provided as an enabling signal, the eight switch transistor Ts8 of the second intra-pixel circuit y is turned on. Thus the driving transistor Td of the second intra-pixel circuit y generates the drive signal at the gate thereof from the image data signal Data(y) loaded to the source thereof, where the voltage Vg(y) of the drive signal is:

$$Vg(y)=Vs(y)+Vth(y)=V\mathrm{data}(y)+Vth(y) \quad (2\text{-}1)$$

Where Vs(y) is the source voltage of the driving transistor Td of the second intra-pixel circuit y, Vth(y) is the threshold voltage of the driving transistor Td, and Vdata(y) is the voltage of the image signal received by the driving transistor Td; and the value of the voltage Vg(y) of the drive signal is stored in the first capacitor C1 of the second intra-pixel circuit y.

In the light emitting phase t82, the third light emitting control EM3 and the fourth light emitting control EM4 at a low level are provided as enabling signals, and both the fifth switch transistor Ts5 and the seventh switch transistor Ts7 in the first intra-pixel circuit x are turned on; Scan3 at a high level is provided as a disabling signal, and the sixth switch transistor Ts6 of the first intra-pixel circuit x is turned off; Scan4(*x*) at a high level is provided as a disabling signal, and the eight switch transistor Ts8 of the first intra-pixel circuit x is turned off; and as per the equation of a current characteristic of a transistor operating in a saturation region, the drain current of the driving transistor Td of the first intra-pixel circuit x is:

$$I(x)=\frac{1}{2}k(Vg(x)-Vs(x)-Vth(x))^2=\frac{1}{2}k(Vdata(x)-Vdd)^2 \quad (1\text{-}2)$$

Where k is a constant. As is apparent from Equation (1-2), the drain current I(x) of the driving transistor Td of the first intra-pixel circuit x is independent from the threshold voltage Vth(x) of the driving transistor Td.

In the meantime, similarly, both the fifth switch transistor Ts5 and the seventh switch transistor Ts7 of the second intra-pixel circuit y are turned on, and the sixth switch transistor Ts6 is turned off; Scan4(*y*) at a high level is provided as a disabling signal, and the eight switch transistor Ts8 of the second intra-pixel circuit y is turned off; and the drain current of the driving transistor Td of the second intra-pixel circuit y is:

$$I(y)=\frac{1}{2}k(Vg(y)-Vs(y)-Vth(y))^2=\frac{1}{2}k(Vdata(y)-Vdd)^2 \quad (2\text{-}2)$$

Where I(y) is the drain current of the driving transistor Td, k is a constant, Vg(y) is the gate voltage of the driving transistor Td, Vs(y) is the source voltage of the driving transistor Td, and Vth(y) is the threshold voltage of the driving transistor Td. As is apparent from Equation (2-2), the drain current I(y) of the driving transistor Td of the second intra-pixel circuit y is also independent from the threshold voltage Vth(y) of the driving transistor Td.

FIG. 15 illustrates the operation principle of the organic light emitting diode pixel driving circuit, which only illustrates the two of the intra-pixel circuits as an example, and since the structure and the operating timing of each of the m intra-pixel circuits are the same as the two intra-pixel circuits illustrated in FIG. 15, and its operating principle is also the same as the operation principle of the two intra-pixel circuits, the operating principle of each of the m intra-pixel circuits can be appreciated by those skilled in the art, so a repeated description thereof will be omitted here.

Figure 17:
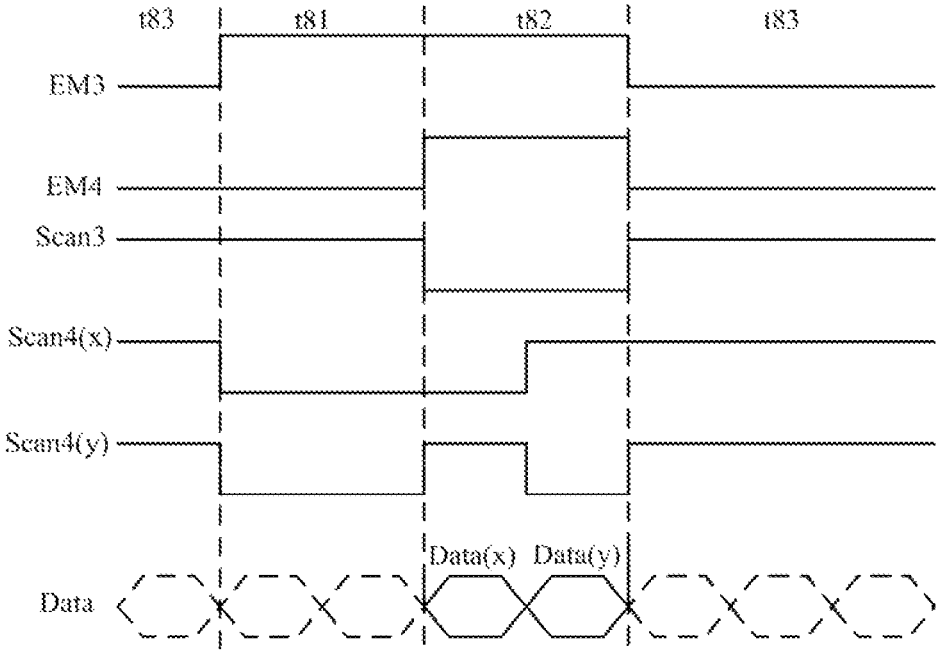
FIG. 17 is a second timing diagram of the organic light emitting diode pixel driving circuit according to the eighth embodiment of the invention in operation.

Alternatively FIG. 17 illustrates a timing diagram of the organic light emitting diode pixel driving circuit according to the eighth embodiment of the invention in operation, where there are three phases including an initialization phase t81, the signal loading phase t82 and the light emitting phase t83 in that order.

In the initialization phase t81 in FIG. 17:

The third scan signal Scan3 at a high level is provided as a disabling signal, and the sixth switch transistor Ts6 is turned off;

The third light emitting control signal EM3 at a high level is provided as a disabling signal, and the fifth switch transistor Ts5 is turned off;

The fourth scan signals Scan4(*x*) and Scan4(*y*) at a low level are provided as enabling signals, and the eighth switch transistors Ts8 of the first intra-pixel circuit x and the second intra-pixel circuit y are turned on; and The fourth light emitting control signal EM4 at a low level is provided as an enabling signal, and the seventh switch transistors Ts7 of the first intra-pixel circuit x and the second intra-pixel circuit y are turned on.

In the first intra-pixel circuit x, both the seventh switch transistors Ts7 and the eighth switch transistors Ts8 are turned on, so the gate of the driving transistor Td receives a second power supply signal Vss, that is, the gate of the driving transistor Td is reset to the voltage of the second power supply signal Vss. Similarly, in the second intra-pixel circuit y, both the seventh switch transistors Ts7 and the eighth switch transistors Ts8 are turned on, so the gate of the driving transistor Td receives the second power supply signal Vss, that is, the gate of the driving transistor Td is reset to Vss. Thus an influence of a signal displayed in a previous frame on the display of a next frame of image can be avoided.

A condition of the organic light emitting diode pixel driving circuit according to the eighth embodiment of the invention operating in the signal loading phase t82 in FIG. 17 will be the same as the condition of the organic light emitting diode pixel driving circuit according to the eighth embodiment of the invention operating in the signal loading phase in FIG. 16, so a repeated description thereof will be omitted here.

A condition of the organic light emitting diode pixel driving circuit according to the eighth embodiment of the invention operating in the light emitting phase t83 in FIG. 17 is the same as the condition of the organic light emitting diode pixel driving circuit according to the eighth embodiment of the invention operating in the light emitting phase in FIG. 16, so a repeated description thereof will be omitted here.

Figure 18:
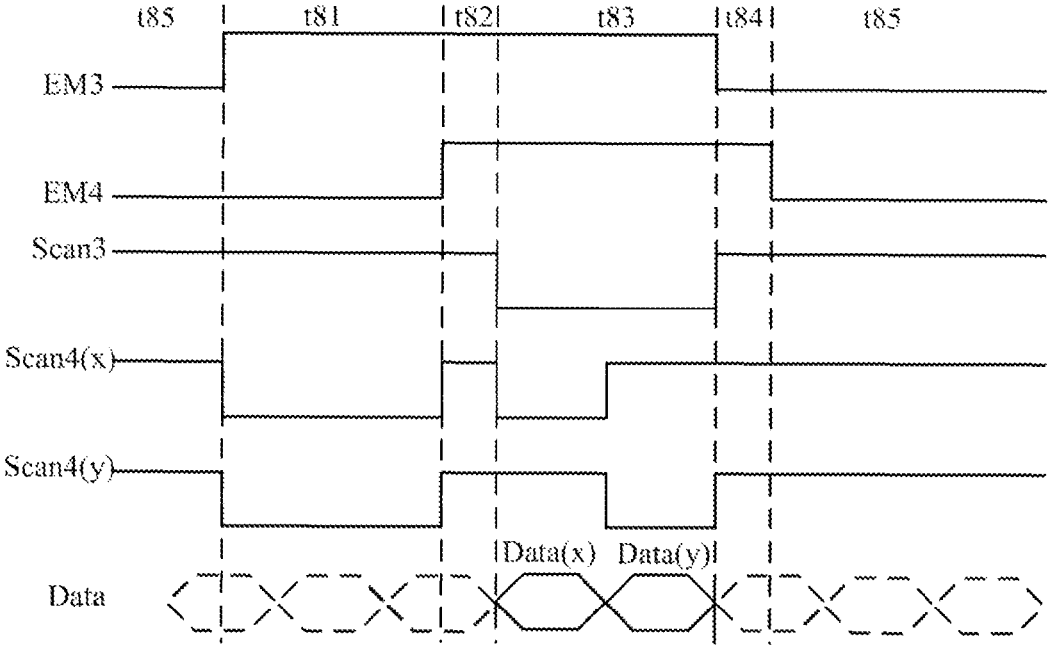
FIG. 18 is a third timing diagram of the organic light emitting diode pixel driving circuit according to the eighth embodiment of the invention in operation.

Alternatively FIG. 18 illustrates another timing diagram of the organic light emitting diode pixel driving circuit according to the eighth embodiment of the invention in operation, where there are five phases including an initialization phase t81, a first wait phase t82, the signal loading phase t83, a second wait phase t84 and the light emitting phase t85 in that order.

A condition of the organic light emitting diode pixel driving circuit according to the eighth embodiment of the invention operating in the initialization phase t81 in FIG. 18 is the same as the condition of the organic light emitting diode pixel driving circuit according to the eighth embodiment of the invention operating in the initialization phase in FIG. 17, so a repeated description thereof will be omitted here.

In the first wait phase t82 in FIG. 18:

The third scan signal Scan3 at a high level is provided as a disabling signal, and the sixth switch transistor Ts6 is turned off;

The third light emitting control signal EM3 at a high level is provided as a disabling signal, and the fifth switch transistor Ts5 is turned off;

The fourth scan signals Scan4(*x*) and Scan4(*y*) at a high level are provided as disabling signal, and the eighth switch transistor Ts8 of the first intra-pixel circuit x and the eighth switch transistor Ts8 of the second intra-pixel circuit y are turned off; and The fourth light emitting control signal EM4 at a high level is provided as a disabling signal, and the seventh switch transistor Ts7 of the first intra-pixel circuit x and the seventh switch transistor Ts7 of the second intra-pixel circuit y are turned off. With the first wait phase t82, the signal can be ensured to be loaded after the seventh switch transistor Ts7 is turned off.

A condition of the organic light emitting diode pixel driving circuit according to the eighth embodiment of the invention operating in the signal loading phase t83 in FIG. 18 is the same as the condition of the organic light emitting diode pixel driving circuit according to the eighth embodiment of the invention operating in the signal loading phase in FIG. 15, so a repeated description thereof will be omitted here.

In the second wait phase t84 in FIG. 18:

The third scan signal Scan3(*x*), received by the gate of the sixth switch transistor Ts6, is at a high level; the fourth scan signal Scan4(*x*) received by the gate of the eighth switch transistor Ts8 in the pixel element including the organic light emitting diode Dx is at a high level, so the eighth switch transistor Ts8 in the pixel element including the organic light emitting diode Dx is turned off; the fourth scan signal Scan4(*y*) received by the gate of the eighth switch transistor Ts8 in the pixel element including the organic light emitting diode Dy is at a high level, so the eighth switch transistor Ts8 in the pixel element including the organic light emitting diode Dy is turned off; the fourth light emitting control signal EM4 received by the gate of the seventh switch transistor Ts7 in the pixel element including the organic light emitting diode Dx is at a high level, so the seventh switch transistor Ts7 in the pixel element including the organic light emitting diode Dx is turned off; the fourth light emitting control signal EM4 received by the gate of the seventh switch transistor Ts7 in the pixel element including the organic light emitting diode Dy is at a high level, so the seventh switch transistor Ts7 in the pixel element including the organic light emitting diode Dy is turned off; and the third light emitting control EM3 received by the gate of the fifth switch transistor Ts5 is at a low level, so the fifth switch transistor Ts5 is turned on. With the second wait phase t84, the pixel element can be ensured to emit light for display after the eighth switch transistor Ts8 is turned off.

A condition of the organic light emitting diode pixel driving circuit according to the eighth embodiment of the invention operating in the light emitting phase t85 in FIG. 18 is the same as the condition of the organic light emitting diode pixel driving circuit according to the eighth embodiment of the invention operating in the light emitting phase in FIG. 15, so a repeated description thereof will be omitted here.

An organic light emitting diode pixel driving circuit according to a ninth embodiment of the invention includes an external circuit and a number m of intra-pixel circuits, each of intra-pixel circuits is located inside one of pixel elements and the m intra-pixel circuits are connected with the same data line, where m is larger than or equal to 2 and smaller than or equal to the number of pixel elements connected with the same data line. Each of the intra-pixel circuits includes a signal loading module, a driving transistor and an organic light emitting diode. An operation principle of the organic light emitting diode pixel driving circuit will be described below in the ninth embodiment of the invention with reference to FIG. 19, which only illustrates two of the intra-pixel circuits as an example, and an operation principle of each of the m intra-pixel circuits is the same as the operation principle of the two intra-pixel circuits. The two intra-pixel circuits are any two different ones of the m intra-pixel circuits.

Figure 19:
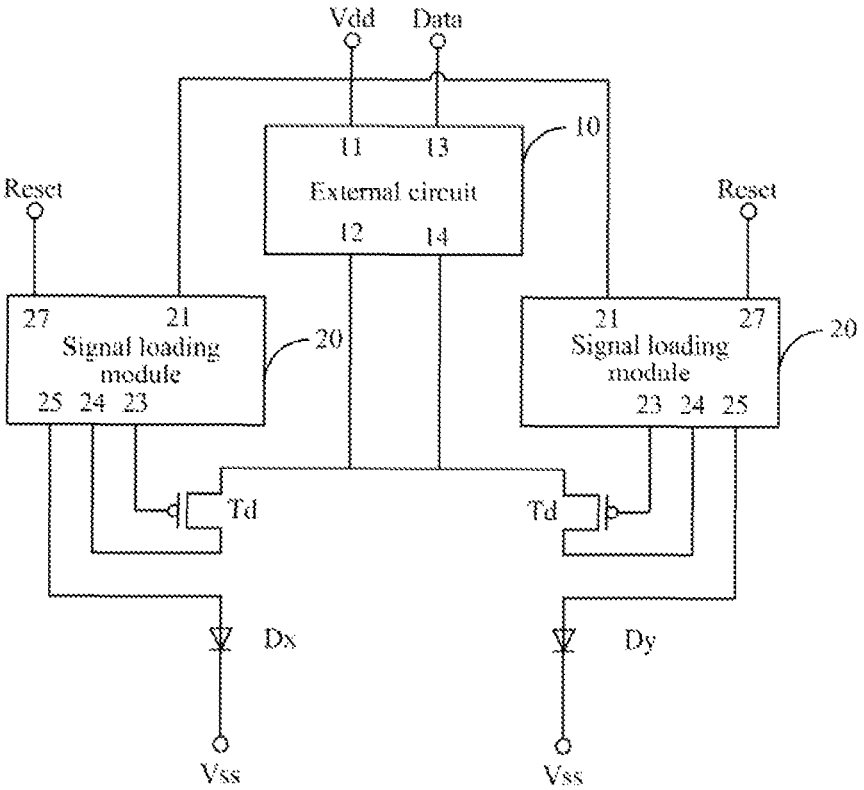
FIG. 19 is a simplified block diagram of an organic light emitting diode pixel driving circuit according to a ninth embodiment of the invention.

In addition to the functions of the organic light emitting diode pixel driving circuit according to the sixth embodiment of the invention, each of the signal loading modules 20 in the circuit illustrated in FIG. 19 is further configured to receive a reset signal Reset by a seventh terminal 27 of the signal loading module 20 and transmit the reset signal Reset to the third terminal 23 of the signal loading module 20 in an initialization phase, which precedes to the signal loading phase, to have the fourth terminal 24 of the signal loading module 20 disconnected from the fifth terminal 25 of the signal loading module 20 in the initialization phase; and to stop transmitting the reset signal Reset in the signal loading phase and the light emitting phase; and The external circuit 10 is further configured to have the first terminal 11 of the external circuit 10 disconnected from the second terminal 12 of the external circuit 10 in the initialization phase.

The organic light emitting diode pixel driving circuit according to the ninth embodiment of the invention has the functions of the organic light emitting diode pixel driving circuit according to the sixth embodiment of the invention, and other conditions of the organic light emitting diode pixel driving circuit according to the ninth embodiment of the invention operating in the signal loading phase and the light emitting phase are the same as the conditions of the organic light emitting diode pixel driving circuit according to the sixth embodiment of the invention operating in these two phases, so a repeated description thereof will be omitted here.

In the organic light emitting diode pixel driving circuit according to the ninth embodiment of the invention, the reset signal Reset received by the seventh terminal 27 of the signal loading module 20 can be transmitted to the third terminal 23 of the signal loading module 20 in the initialization phase, that is, the reset signal Reset can be loaded to the gate of the driving transistor Td in the initialization phase, to thereby eliminate an influence of a signal displayed in a previous frame on the display of a next frame of image so as to achieve a better display effect.

Figure 20:
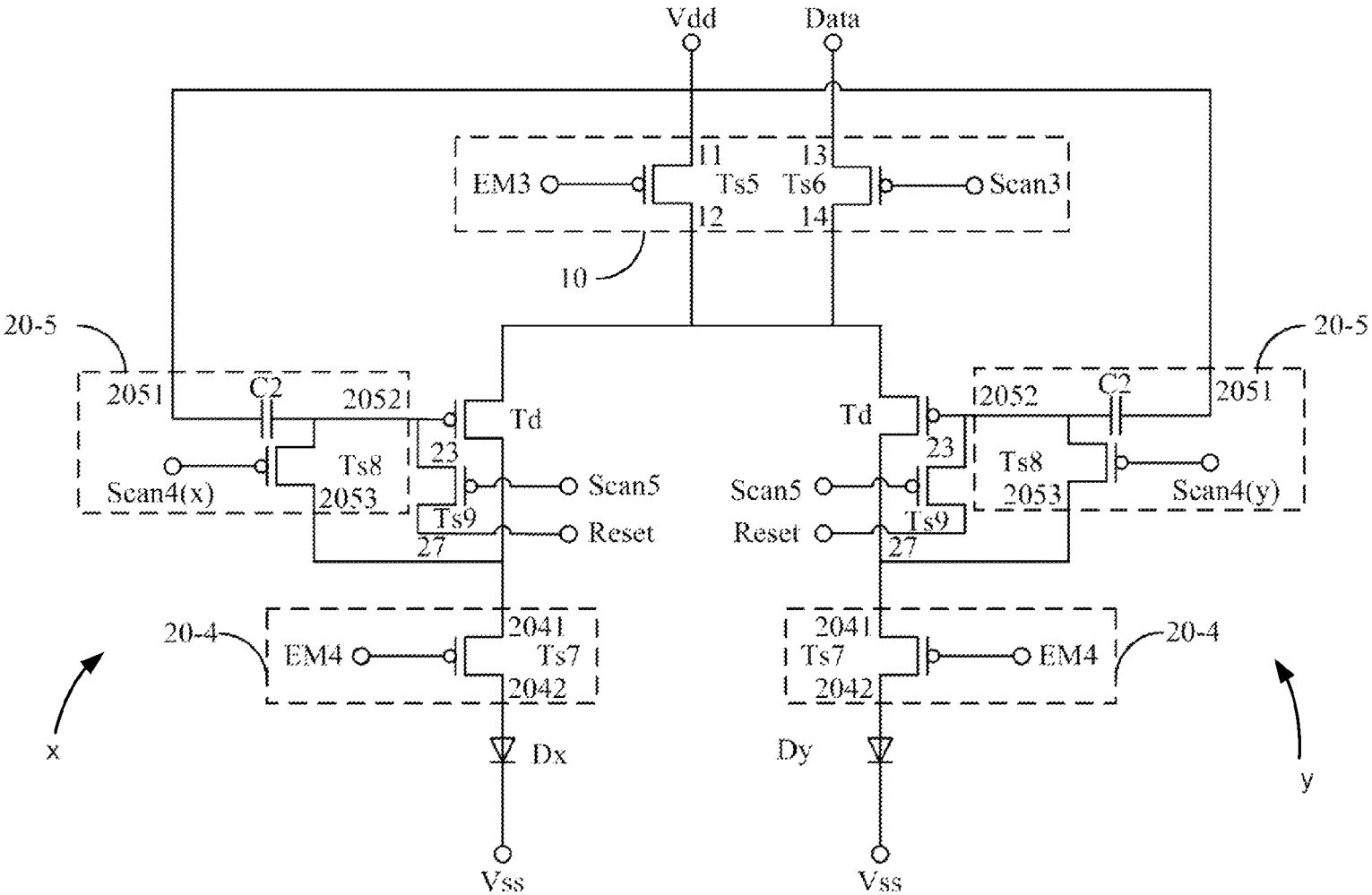
FIG. 20 is a simplified block diagram of an organic light emitting diode pixel driving circuit according to a tenth embodiment of the invention.

An organic light emitting diode pixel driving circuit according to a tenth embodiment of the invention includes an external circuit and a number m of intra-pixel circuits, each of intra-pixel circuits is located inside corresponding one of pixel elements and the m intra-pixel circuits are connected with the same data line, where m is larger than or equal to 2 and smaller than or equal to the number of pixel elements connected with the same data line. Each of the intra-pixel circuits includes a signal loading module, a driving transistor and an organic light emitting diode. An operation principle of the organic light emitting diode pixel driving circuit will be described below in the tenth embodiment of the invention with reference to FIG. 20, which only illustrates two of the intra-pixel circuits as an example, and an operation principle of each of the m intra-pixel circuits is the same as the operation principle of the two intra-pixel circuits. As illustrated in FIG. 20, the organic light emitting diode pixel driving circuit according to the tenth embodiment of the invention includes two intra-pixel circuits which are any two different ones of the m intra-pixel circuits.

In addition to the functions of the organic light emitting diode pixel driving circuit according to the eighth embodiment of the invention, each of the intra-pixel circuits in the circuit illustrated in FIG. 20 further includes a ninth switch transistor Ts9, where a first terminal 27 of the ninth switch transistor Ts9 is a seventh terminal of the signal loading module which receives a reset signal Reset, a gate of the ninth switch transistor Ts9 receives a fifth scan signal Scan5, and a second terminal 23 of the ninth switch transistor Ts9 is the third terminal of the signal loading module, which is connected with a gate of the driving transistor Td. The ninth switch transistor Ts9 is configured to be turned on in the initialization phase to thereby load the reset signal Reset to the gate of the driving transistor Td, and to be turned off in the signal loading phase and the light emitting phase.

Figure 21:
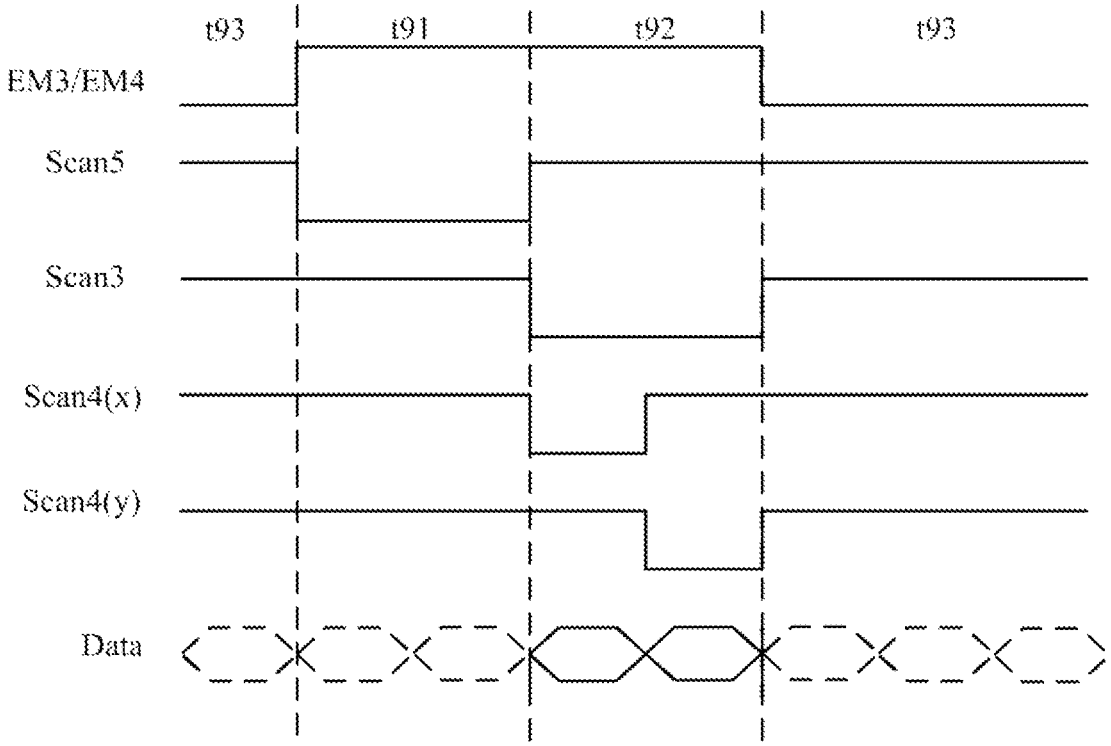
FIG. 21 is a timing diagram of the organic light emitting diode pixel driving circuit according to the tenth embodiment of the invention in operation.

FIG. 21 illustrates a timing diagram of the organic light emitting diode pixel driving circuit according to the tenth embodiment of the invention in operation, where the third light emitting control signal EM3 is the same as the fourth light emitting control signal EM4, and there are three phases including the initialization phase t91, the signal loading phase t92 and the light emitting phase t93.

In the organic light emitting diode pixel driving circuit according to the tenth embodiment of the invention, in the initialization phase t91, the m ninth switch transistors Ts9 are turned on, so the reset signal Reset can be loaded to the gates of the m driving transistors Td to thereby eliminate an influence of a signal displayed in a previous frame on the display of a next frame of image.

In the organic light emitting diode pixel driving circuit according to the tenth embodiment of the invention, in the signal loading phase t92, the m ninth switch transistors Ts9 are turned off, so a function of the organic light emitting diode pixel driving circuit according to the tenth embodiment of the invention in the signal loading phase is the same as the function of the organic light emitting diode pixel driving circuit according to the eighth embodiment of the invention, so a repeated description thereof will be omitted here.

In the organic light emitting diode pixel driving circuit according to the tenth embodiment of the invention, in the light emitting phase t93, the m ninth switch transistors Ts9 are turned off, so a function of the organic light emitting diode pixel driving circuit according to the tenth embodiment of the invention in the light emitting phase is the same as the function of the organic light emitting diode pixel driving circuit according to the eighth embodiment of the invention, so a repeated description thereof will be omitted here.

As illustrated in FIG. 6, an organic light emitting diode pixel driving circuit according to an eleventh embodiment of the invention includes an external circuit 10 and a number m of intra-pixel circuits, where m is larger than or equal to 2 and smaller than or equal to the number of pixel elements on a display panel; and each of the intra-pixel circuits is located inside corresponding one of pixel elements, and as illustrated in FIG. 6, the same external circuit is shared by two intra-pixel circuits located in two adjacent rows as an example.

The external circuit 10 includes a first switch transistor Ts1, where the first switch transistor Ts1 includes a first terminal which receives a first power supply signal Vdd, and a gate which receives a first light emitting control signal EM1;

The intra-pixel circuit including an organic light emitting diode Dx further includes a second switch transistor Ts2, a third switch transistor Ts3, a fourth switch transistor Ts4, a driving transistor Td and a first capacitor C1;

The intra-pixel circuit including an organic light emitting diode Dy further includes a second switch transistor Ts2, a third switch transistor Ts3, a fourth switch transistor Ts4, a driving transistor Td and a first capacitor C1;

The second switch transistor Ts2, in the intra-pixel circuit including the organic light emitting diode Dx, includes a first terminal which receives an image data signal Data(x), and a gate which receives a first scan signal Scan1(*x*);

The second switch transistor Ts2, in the intra-pixel circuit including the organic light emitting diode Dy, includes a first terminal which receives an image data signal Data(y), and a gate which receives a first scan signal Scan1(*y*);

The first capacitor C1 includes one terminal plate which receives the first power supply signal Vdd, and the other terminal plate which is connected respectively with a gate of the driving transistor Td and a first terminal of the fourth switch transistor Ts4;

The driving transistor Td includes a source connected respectively with a second terminal of the first switch transistor Ts1 and a second terminal of the second switch transistor Ts2, and a drain connected respectively with a first terminal of the third switch transistor Ts3 and a second terminal of the fourth switch transistor Ts4;

The third switch transistor Ts3 includes a gate which receives a second light emitting control signal EM2, and a second terminal connected with an anode of the organic light emitting diode Dx or Dy;

The fourth switch transistor Ts4, in the intra-pixel circuit including the organic light emitting diode Dx, includes a gate which receives a second scan signal Scan2(*x*);

The fourth switch transistor Ts4, in the intra-pixel circuit including the organic light emitting diode Dy, includes a gate which receives a second scan signal Scan2(*y*); and The organic light emitting diode Dx or Dy includes a cathode which receives a second power supply signal Vss.

There is an organic light emitting diode pixel driving circuit according to a twelfth embodiment of the invention, where each of the intra-pixel circuits further includes a fifth switch transistor; and the fifth switch transistor includes a gate which receives a third scan signal, a first terminal which receives a reset signal, and a second terminal which is connected with the gate of the driving transistor.

The structure of the organic light emitting diode pixel driving circuit according to the twelfth embodiment of the invention is the same as that of the circuit illustrated in FIG. 10, where the fifth switch transistor in the twelfth embodiment of the invention is the ninth switch transistor Ts9 in FIG. 10, and the third scan signal in the twelfth embodiment of the invention is the fifth scan signal Scan5 in FIG. 10.

An organic light emitting diode pixel driving circuit according to a thirteen embodiment of the invention includes an external circuit and a number m of intra-pixel circuits, where respective pixels, where respective ones of the m intra-pixel circuits are located, are located in the same column, and m is larger than or equal to 2 and smaller than or equal to a total number of pixels in a column on a display panel;

The external circuit includes a first switch transistor and a second switch transistor:

The first switch transistor includes a first terminal which includes a first power supply signal, and a gate which receives a first light emitting control signal;

The second switch transistor includes a first terminal which receives an image data signal, and a gate which receives a first scan signal;

Each of the intra-pixel circuits includes a third switch transistor, a fourth switch transistor, a driving transistor, a first capacitor and an organic light emitting diode;

The first capacitor includes one terminal plate which receives the first power supply signal, and the other terminal plate which is connected respectively with a gate of the driving transistor and a first terminal of the fourth switch transistor, The driving transistor includes a source which is connected respectively with a second terminal of the first switch transistor and a second terminal of the second switch transistor, and a drain which is connected respectively with a first terminal of the third switch transistor and a second terminal of the fourth switch transistor;

The third switch transistor includes a gate which receives a second light emitting control signal, and a second terminal which is connected with an anode of the organic light emitting diode;

The fourth switch transistor includes a gate which receives a second scan signal; and The organic light emitting diode includes a cathode which receives a second power supply signal.

The structure of the organic light emitting diode pixel driving circuit according to the thirteen embodiment of the invention is the same as that of the circuit illustrated in FIG. 14, where the first switch transistor in the thirteen embodiment of the invention is the fifth switch transistor Ts5 in FIG. 14, the first light emitting control signal in the thirteen embodiment of the invention is the third light emitting signal EM3 in FIG. 14, the second switch transistor in the thirteen embodiment of the invention is the sixth switch transistor Ts6 in FIG. 14, the first scan signal in the thirteen embodiment of the invention is the third scan signal Scan3 in FIG. 14, the third switch transistor in the thirteen embodiment of the invention is the seventh switch transistor Ts7 in FIG. 14, the second light emitting control signal in the thirteen embodiment of the invention is the fourth light emitting control signal EM4 in FIG. 14, the fourth switch transistor in the thirteen embodiment of the invention is the eighth switch transistor Ts8 in FIG. 14, the second scan signal in the thirteen embodiment of the invention is the fourth scan signal Scan4(*x*) or Scan4(*y*) in FIG. 14, and the first capacitor in the thirteen embodiment of the invention is the second capacitor C2 in FIG. 14.

There is an organic light emitting diode pixel driving circuit according to a fourteenth embodiment of the invention, where each of the intra-pixel circuits further includes a fifth switch transistor; and the fifth switch transistor includes a gate which receives a third scan signal, a first terminal which receives a reset signal, and a second terminal which is connected with the gate of the driving transistor.

The structure of the organic light emitting diode pixel driving circuit according to the fourteenth embodiment of the invention is the same as that of the circuit illustrated in FIG. 19, where the fifth switch transistor in the fourteenth embodiment of the invention is the ninth switch transistor Ts9 in FIG. 19, and the third scan signal in the fourteenth embodiment of the invention is the fifth scan signal Scan5 in FIG. 19.

A display device according to an embodiment of the invention includes the organic light emitting diode pixel driving circuit according to any one of the first embodiment to the fourteenth embodiment of the invention.

A first terminal of a switch transistor as referred to in the embodiments of the invention can be a source (or a drain) of the switch transistor, and the second terminal of the switch transistor can be the drain (or the source) of the switch transistor. If the source of the switch transistor is the first pole, then the drain of the switch transistor is the second pole; and if the drain of the switch transistor is the first pole, then the source of the switch transistor is the second pole.

Those skilled in the art can appreciate that the drawings are merely schematic diagrams of some preferred embodiments of the invention and the modules or flows in the drawings may not be necessarily required to implement the invention.

Those skilled in the art can appreciate that the modules in the devices according to the embodiments can be distributed in the devices of the embodiments as described in the embodiments or located in one or more devices other than the embodiments while being modified correspondingly. The modules in the foregoing embodiments can be combined into a module or further divided into a plurality of sub-modules.

The foregoing embodiments of the invention have been numbered merely for the convenience of their description but will not indicate any precedence of one embodiment over the other.

Evidently those skilled in the art can make various modifications and variations to the invention without departing from the spirit and scope of the invention. Thus the invention is also intended to encompass these modifications and variations thereto so long as the modifications and variations come into the scope of the appended claims and their equivalents.

What is claimed is:

1. An organic light emitting diode pixel driving circuit in a display panel, comprising:

a plurality of pixel elements;

a plurality of data lines;

a plurality of intra-pixel circuits, each comprising a signal loading module, a driving transistor, and an organic light emitting diode, wherein the number of the plurality of intra-pixel circuits is an integer ranging from 2 to the total number of the pixel elements on the display panel;

a common circuit, wherein a first terminal of the common circuit receives a first power supply signal, a second terminal of the common circuit is connected respectively with a source of the driving transistor of each of the plurality of intra-pixel circuits, wherein the common circuit is shared by the plurality of pixel elements;

wherein a first terminal of the signal loading module receives the first power supply signal, a second terminal of the signal loading module is connected with the source of the driving transistor of each of the plurality of intra-pixel circuits, a third terminal of the signal loading module is connected with a gate of the driving transistor of each of the plurality of intra-pixel circuits, a fourth terminal of the signal loading module is connected with a drain of the driving transistor of each of the plurality of intra-pixel circuits, a fifth terminal of the signal loading module is connected with an anode of the organic light emitting diode of each of the plurality of the intra-pixel circuits, a cathode of the organic light emitting diode receives a second power supply signal, and a sixth terminal of the signal loading module receives an image data signal, wherein each of the signal loading modules is configured to receive a first scan signal and a second scan signal, in a signal loading phase, under the control of the first scan signal and the second scan signal to load the image data signal received by its sixth terminal to the source of the driving transistor of each of the plurality of the intra-pixel circuits by its second terminal, to have its third terminal connected with its fourth terminal to generate and store a drive signal, and to have its fourth terminal disconnected from its fifth terminal, wherein each of the signal loading modules is configured, in a light emitting phase, under the control of the first scan signal and the second scan signal to have its third terminal disconnected from its fourth terminal, to have its fourth terminal connected with its fifth terminal, and to control the driving transistor of each of the plurality of intra-pixel circuits by the drive signal stored in the signal loading phase and the signal at the source of the driving transistor of each of the plurality of intra-pixel circuits to drive the organic light emitting diode of each of the plurality of the intra-pixel circuits to emit light, wherein the common circuit is configured to have its first terminal disconnected from its second terminal in the signal loading phase, and to have its first terminal connected with its second terminal in the light emitting phase, wherein in the light emitting phase, the drain current of the driving transistor of each of the plurality of intra-pixel circuits is independent from threshold voltage of the driving transistor of each of the plurality of intra-pixel circuits, and is dependent on a voltage of the first power supply signal and a voltage of the image data signal, wherein each of the signal loading modules comprises a first drive signal generation and storage element, wherein a first terminal of the first drive signal generation and storage element is the first terminal of the signal loading module, a second terminal of the first drive signal generation and storage element is the third terminal of the signal loading module, and a third terminal of the first drive signal generation and storage element is the fourth terminal of the signal loading module, wherein the first drive signal generation and storage element is configured to have its second terminal connected N ith its third terminal in the signal loading phase to generate the drive signal from the signal at the source of the driving transistor of each of the plurality of intra-pixel circuits and store the drive signal, and in the remaining period of the signal loading phase and in the light emitting phase, to have its second terminal disconnected from its third terminal: and in the light emitting phase, to control the driving transistor by the stored drive signal to drive the organic light emitting diode to emit light, wherein the first drive signal generation and storage element further comprises a first capacitor and a fourth switch transistor, wherein one terminal of the first capacitor is the first terminal of the first drive signal generation and storage element, and another terminal of the first capacitor is the second terminal of the first drip e signal generation and storage element, wherein a first terminal of the fourth switch transistor is the second terminal of the first drive signal generation and storage element, a gate of the fourth switch transistor receives the second scan signal, which is the same as a signal on a gate line connected with the pixel element where the intra-pixel circuit comprising the first drive signal generation and storage element is located, and a second terminal of the fourth switch transistor is the third terminal of the first drive signal generation and storage element, the gate of the fourth switch transistor receives the fourth scan signal, and a second terminal of the fourth switch transistor is the third terminal of the second drive signal generation and storage element, wherein the fourth switch transistor is configured to be turned on in the portion of the signal loading phase, and to be turned off in the remaining portion of the signal loading phase and in the light emitting phase, and wherein the first capacitor is configured to store the drive signal.

2. The organic light emitting diode pixel driving circuit according to claim 1, wherein the pixel elements associated with the signal loading modules correspond to the different data lines.

3. The organic light emitting diode pixel driving circuit according to claim 1, wherein the common circuit comprises a first switch transistor, wherein a first terminal of the first switch transistor is the first terminal of the common circuit, a gate of the first switch transistor receives a light emitting control signal, and a second terminal of the first switch transistor is the second terminal of the common circuit; and wherein the first switch transistor is configured to turn on in the light emitting phase and to turn off in the signal loading phase.

4. The organic light emitting diode pixel driving circuit according to claim 1, wherein each of the signal loading modules comprises a first switch element, a second switch element, and the first drive signal generation and storage element, wherein a first terminal of the first switch element is the sixth terminal of the signal loading module, and a second terminal of the first switch element is the second terminal of the signal loading module, wherein a first terminal of the second switch element is the fourth terminal of the signal loading module, and a second terminal of the second switch element is the fifth terminal of the signal loading module, wherein the first switch element is configured to transmit the image data signal received by its first terminal to the source of the driving transistor of the intra-pixel circuit in a portion of the signal loading phase, and to stop transmitting the image data signal received by its first terminal to the source of the driving transistor of the intra-pixel circuit in a remaining portion of the signal loading phase and in the light emitting phase, and wherein the second switch element is configured to have its first terminal connected with its second terminal in the light emitting phase and to have its first terminal disconnected from its second terminal.

5. The organic light emitting diode pixel driving circuit according to claim 4, wherein the first switch element further comprises a second switch transistor, wherein a first terminal of the second switch transistor is a first terminal of the first switch element, a gate of the second switch transistor receives the first scan signal, and a second terminal of the second switch transistor is the second terminal of the first switch element; and wherein the second switch transistor is configured to turn on in the portion of the signal loading phase; and to turn off in the remaining portion of the signal loading phase and in the light emitting phase.

6. The organic light emitting diode pixel driving circuit according to claim 4, the second switch element further comprises a third switch transistor, wherein a first terminal of the third switch transistor is the first terminal of the second switch element, a gate of the third switch transistor receives a second light emitting control signal, and a second terminal of the third switch transistor is the second terminal of the second switch element, and wherein the third switch transistor is configured to be turned on in the light emitting phase and to be turned off in the signal loading phase.

7. An organic light emitting diode pixel driving circuit in a display panel, comprising:

a plurality of pixel elements;

a plurality of data lines;

an common circuit; and a plurality of intra-pixel circuits, each of the plurality of intra-pixel circuits comprises a signal loading module, a driving transistor and an organic light emitting diode, wherein the plurality of intra-pixel circuits are connected with a same data line, and the number of the plurality of intra-pixel circuits is an integer greater ranging from 2 to the total number of pixel elements connected on the display panel with the same data line, the common circuit comprises two transistors;

wherein a first terminal of the common circuit receives a first power supply signal, a second terminal of the common circuit is connected respectively with a source of the driving transistor of each of the m intra-pixel circuits, a third terminal of the common circuit receives an image data signal, and a fourth terminal of the common circuit is connected with the source of the driving transistor of each of the plurality of intra-pixel circuits, wherein the common circuit receives a third scan signal, wherein the common circuit is shared by the plurality of pixel elements, wherein for each of the signal loading modules, a first terminal of the signal loading module receives the first power supply signal, a third terminal of the signal loading module is connected with a gate of the driving transistor, a fourth terminal of the signal loading module is connected with a drain of the driving transistor, a fifth terminal of the signal loading module is connected with an anode of the organic light emitting diode of the intra-pixel circuit, and a cathode of the organic light emitting diode receives a second power supply signal, wherein the common circuit is configured, in a signal loading phase, to have its first terminal disconnected from its second terminal, to have its third terminal connected with its fourth terminal under the control of the third scan signal, and to transmit the image data signal to the source of the driving transistor by its fourth terminal, wherein the common circuit is configured, in a light emitting phase, to have its first terminal connected with its second terminal, and wherein each of the signal loading modules is configured to receive the fourth scan signal in the signal loading phase, under the control of the fourth scan signal to have its third terminal connected with its fourth terminal to generate and store a drive signal, and to have its fourth terminal disconnected from its fifth terminal, wherein each of the signal loading modules is configured, in the light emitting phase, under the control of the fourth scan signal to have its third terminal disconnected from its fourth terminal, to have its fourth terminal connected with its fifth terminal, and to control the driving transistor by the drive signal stored in the signal loading phase and the signal at the source of the driving transistor to drive the organic light emitting diode of the intra-pixel circuit comprising the signal loading module to emit light, wherein in the light emitting phase, the drain current of the driving transistor of each of the plurality of intra-pixel circuits is independent from a threshold voltage of the driving transistor, and is dependent on a voltage of the first power supply signal and a voltage of the image data signal, wherein each of the signal loading modules comprises a second drive signal generation and storage element, wherein a first terminal of the second drive signal generation and storage element is the first terminal of the signal loading module, a second terminal of the second drive signal generation and storage element is the third terminal of the signal loading module, and a third terminal of the second drive signal generation and storage element is the fourth terminal of the signal loading module, wherein the second drive signal generation and storage element is configured, in the signal loading phase, to have its second terminal connected with its third terminal to thereby generate the drive signal from the signal at the source of the driving transistor in the intra-pixel element comprising the second drive signal generation and storage element and store the drive signal; and in the light emitting phase, to have its second terminal disconnected from its third terminal, and wherein the second drive signal generation and storage element is configured, in the light emitting phase, to control the driving transistor by the stored drive signal to drive the organic light emitting diode to emit light, wherein the second drive signal generation and storage element further comprises a second capacitor and an eighth switch transistor, wherein one terminal of the second capacitor is the first terminal of the second drive signal generation and storage element, and the other terminal of the second capacitor is the second terminal of the second drive signal generation and storage element, wherein a first terminal of the eighth switch transistor is the second terminal of the second drive signal generation and storage element, a gate of the eighth switch transistor receives the fourth scan signal, which is the same as a signal on a gate line connected with the pixel element where the intra-pixel circuit comprising the second drive signal generation and storage element is located, and a second terminal of the eighth switch transistor is the third terminal of the second drive signal generation and storage element, wherein the eighth switch transistor is configured to be turned on in a portion of the signal loading phase, and to be turned off in a remaining portion of the signal loading phase and in the light emitting phase, and wherein the second capacitor is configured to store the drive signal.

8. The organic light emitting diode pixel driving circuit according to claim 7, wherein the common circuit further comprises a fifth switch transistor and a sixth switch transistor, wherein a first terminal of the fifth switch transistor is the first terminal of the common circuit, a gate of the fifth switch transistor receives a third light emitting control signal, and a second terminal of the fifth switch transistor is the second terminal of the common circuit, wherein a first terminal of the sixth switch transistor is the third terminal of the common circuit, a gate of the sixth switch transistor receives the third scan signal, and a second terminal of the sixth switch transistor is the fourth terminal of the common circuit, wherein the fifth switch transistor is configured to turn off in the signal loading phase and to be turned on in the light emitting phase, and wherein the sixth switch transistor is configured to turn on in the signal loading phase and to be turned off in the light emitting phase.

9. The organic light emitting diode pixel driving circuit according to claim 7, wherein each of the signal loading modules comprises a third switch element and the second drive signal generation and storage element, wherein a first terminal of the third switch element is the fourth terminal of the signal loading module, and a second terminal of the third switch element is the fifth terminal of the signal loading module, and wherein the third switch element is configured to have its first terminal connected with its second terminal in the light emitting phase, and to have its first terminal disconnected from its second terminal in the signal loading phase.

10. The organic light emitting diode pixel driving circuit according to claim 9, wherein the third switch element further comprises a seventh switch transistor, wherein a first terminal of the seventh switch transistor is the first terminal of the third switch element, a gate of the seventh switch transistor receives a fourth light emitting control signal, and a second terminal of the seventh switch transistor is the second terminal of the third switch element, and wherein the seventh switch transistor is configured to be turned on in the light emitting phase and to be turned off in the signal loading phase.

11. The organic light emitting diode pixel driving circuit according to claim 1, wherein each of the signal loading modules is further configured to transmit a reset signal by its seventh terminal to its third terminal in an initialization phase which precedes the signal loading phase, to stop transmitting the reset signal in the signal loading phase and in the light emitting phase, and to have its fourth terminal disconnected from its fifth terminal in the initialization phase; and wherein the common circuit is further configured to have its first terminal disconnected from its second terminal in the initialization phase.

12. The organic light emitting diode pixel driving circuit according to claim 11, wherein each of the signal loading modules further comprises a ninth switch transistor, wherein a first terminal of the ninth switch transistor is the seventh terminal of the signal loading module, a gate of the ninth switch transistor receives a fifth scan signal, and a second terminal of the ninth switch transistor is the third terminal of the signal loading module, and wherein the ninth switch transistor is configured to be turned on in the initialization phase and to be turned off in the signal loading phase and in the light emitting phase.

13. The organic light emitting diode pixel driving circuit according to claim 1, wherein each of the signal loading modules is further configured to have its third terminal of the signal loading module connected with its fourth terminal and to have its fourth terminal connected with its fifth terminal in an initialization phase which precedes the signal loading phase.

14. The organic light emitting diode pixel driving circuit according to claim 13, wherein the organic light emitting diode pixel driving circuit is configured to perform a first wait phase between the signal loading phase and the initialization phase and a second wait phase between the signal loading phase and the light emitting phase, wherein each of the signal loading modules is further configured to have its third terminal disconnected from its fourth terminal and to have its fourth terminal disconnected from its fifth terminal in the first wait phase and the second wait phase, and wherein the common circuit is further configured to have its first terminal disconnected from its second terminal in the first wait phase and to have its first terminal connected with its second terminal in the second wait phase.

* * * * *